US010253500B2

(12) United States Patent
Edoo

(10) Patent No.: US 10,253,500 B2
(45) Date of Patent: Apr. 9, 2019

(54) CORROSION RESISTANT CONCRETE REINFORCING MEMBER

(71) Applicant: Quai-de Azam Edoo, South Fremantle (AU)

(72) Inventor: Quai-de Azam Edoo, South Fremantle (AU)

( * ) Notice: Subject to any disclaimer, the term of this patent is extended or adjusted under 35 U.S.C. 154(b) by 260 days.

(21) Appl. No.: 14/428,825

(22) PCT Filed: Sep. 20, 2013

(86) PCT No.: PCT/AU2013/001087

§ 371 (c)(1),
(2) Date: Mar. 17, 2015

(87) PCT Pub. No.: WO2014/047677

PCT Pub. Date: Apr. 3, 2014

(65) Prior Publication Data

US 2015/0218814 A1 Aug. 6, 2015

(30) Foreign Application Priority Data

Sep. 26, 2012 (AU) ..... 2012904199

(51) Int. Cl.

| | |
|---|---|
| ***E04C 5/07*** | (2006.01) |
| ***E04C 5/01*** | (2006.01) |
| *E04C 5/03* | (2006.01) |

(52) U.S. Cl.

CPC ..... *E04C 5/07* (2013.01); *E04C 5/01* (2013.01); *E04C 5/03* (2013.01); *Y10T 428/13* (2015.01); *Y10T 428/1393* (2015.01)

(58) Field of Classification Search

CPC . E04C 5/03; E04C 5/0604; E04C 5/07; E04C 2003/0421; E04C 5/00; E04C 5/01;

(Continued)

(56) References Cited

U.S. PATENT DOCUMENTS 199,887 A * 1/1878 Wight ..... E04C 3/34 52/423
732,485 A * 6/1903 Wight ..... E04C 3/34 52/649.3

(Continued)

FOREIGN PATENT DOCUMENTS

CN 1091799 A 9/1994
DE 2100874 A1 * 7/1972 ..... E04B 1/19

(Continued)

OTHER PUBLICATIONS

PCT/AU2013/001087 International Search Report dated Oct. 31, 2013 (3 pages).

(Continued)

*Primary Examiner* — Robert Canfield
(74) *Attorney, Agent, or Firm* — Brinks Gilson & Lione; John C. Freeman

(57) ABSTRACT

A corrosion resistant concrete reinforcing member includes (i) an elongate core member defining a longitudinal axis; (ii) a longitudinally extending outer wall connected to and extending around the elongate core; and (iii) a void between the elongate core and the outer wall that is in fluid communication with the outside of the reinforcement member; wherein the surface area defined by the portions of the elongate core and the outer wall that define the void is adapted to contact concrete and assist in mechanical bonding of the reinforcing member to the concrete.

9 Claims, 17 Drawing Sheets

(58) Field of Classification Search
CPC ... E04C 3/20; E04C 3/29; E04C 3/293; E04C 3/34; A47B 96/1466; A47B 96/1483; E04B 2/744; E04B 1/20; E04B 1/22
USPC ... 52/649.1, 649.3, 834, 835, 843, 847, 852, 52/854, 780, 781, 309.7, 309.16, 414, 52/649.2, 431, 601; 165/183, DIG. 533
See application file for complete search history.

(56) References Cited

U.S. PATENT DOCUMENTS 971,353 A * 9/1910 Brayton et al. ..... 52/600
1,100,742 A 6/1914 Kane
1,315,661 A 9/1919 Goldie
1,573,735 A * 2/1926 Nelson ..... E04C 5/00 52/254
1,655,407 A * 1/1928 Bennett ..... E04B 1/944 52/423
3,086,627 A * 4/1963 Bernard ..... E04B 2/744 52/244
3,411,545 A * 11/1968 Keyser ..... F16L 9/08 138/175
3,462,110 A * 8/1969 Cheslock ..... A47B 57/56 248/219.4
3,528,559 A * 9/1970 Miller ..... E04B 2/7433 211/180
3,637,084 A * 1/1972 Uitz ..... A47F 5/0853 16/94 D
3,841,042 A * 10/1974 Siegal ..... E04B 2/744 52/239
3,863,414 A 2/1975 Dunn, Jr.
4,017,199 A * 4/1977 Strassle ..... A47B 57/565 403/190
4,021,973 A * 5/1977 Hegg ..... A47G 5/00 160/351
4,163,537 A * 8/1979 Mourgue ..... A47B 17/003 108/156
4,286,655 A * 9/1981 Trojani ..... F28F 1/10 138/38
4,439,972 A * 4/1984 Tolliver ..... E04C 5/0627 138/175
4,583,359 A * 4/1986 Staeger ..... E04B 1/5837 403/255
4,805,365 A * 2/1989 Bastian ..... E04B 2/744 52/282.2
4,936,068 A * 6/1990 VictorSchonfeld ... B21C 35/026 52/100
5,474,501 A * 12/1995 Teng ..... A63J 11/00 403/306
5,647,650 A * 7/1997 Daugherty ..... A47B 57/565 108/180
5,651,630 A * 7/1997 Nomura ..... E04B 1/5806 403/170
5,791,806 A * 8/1998 Giehl ..... E04B 2/7809 16/321
5,843,266 A 12/1998 Greenwood
5,864,997 A * 2/1999 Kelly ..... A01G 9/14 403/294
5,950,393 A 9/1999 Stecker
5,966,895 A 10/1999 Stecker
5,979,119 A * 11/1999 Trafton ..... E04B 1/2403 52/40
6,023,903 A 2/2000 Stecker
D427,669 S * 7/2000 Ruuska ..... D23/266
6,123,485 A * 9/2000 Mirmiran ..... E02D 31/02 405/232
6,250,843 B1 * 6/2001 Olson ..... A47B 87/008 312/245
6,397,537 B2 * 6/2002 Auer ..... E04B 2/744 403/170
6,547,088 B1 * 4/2003 Wang ..... A47B 96/1466 211/187
6,553,738 B1 * 4/2003 Rixen ..... E04B 2/766 52/843
6,643,982 B1 * 11/2003 Lapp, Jr. ..... E04C 3/36 52/127.2
6,682,255 B2 * 1/2004 Battaglia ..... A47F 5/14 403/331
7,121,053 B2 * 10/2006 Toncelli ..... B28B 1/082 52/414
7,178,765 B2 * 2/2007 Huang ..... A47B 21/00 248/122.1
8,065,847 B2 * 11/2011 Gimpel ..... A47B 57/26 52/309.1
8,322,037 B2 * 12/2012 Carlson ..... E04C 3/29 29/527.2
8,484,915 B1 * 7/2013 Abbas ..... E04C 3/34 405/232
D697,231 S * 1/2014 Ono ..... D25/126
8,794,861 B2 * 8/2014 Holscher ..... F16B 7/187 403/253
9,211,027 B2 * 12/2015 Ovist ..... A47H 1/04
9,267,286 B2 * 2/2016 Kim ..... E04C 3/34
2005/0223673 A1 * 10/2005 Cadwell ..... E04H 12/02 52/834
2006/0207211 A1 * 9/2006 Yin ..... E04C 3/34 52/837
2008/0127599 A1 6/2008 Chen
2009/0038263 A1 * 2/2009 Douet ..... E04B 1/30 52/841
2015/0113913 A1 * 4/2015 Kim ..... E04C 3/34 52/834
2016/0251844 A1 * 9/2016 Allen ..... E04H 9/021 52/834

FOREIGN PATENT DOCUMENTS

DE 9106747 U1 * 8/1991 ..... E04B 2/744
DE 10109590 9/2002
EP 0010475 * 4/1980
EP 1 118 728 A2 * 7/2001
EP 1 420 123 A1 5/2004
GB 2 411 183 A 8/2005
GB 2411183 8/2005
KR 20120105251 A 9/2012

OTHER PUBLICATIONS

Chinese Office Action with English language translation for related application No. CN 201380050441.6, dated Dec. 31, 2015, 18 pgs.
Supplementary European Search Report for related application No. EP 13840813.3, dated Apr. 25, 2016, 5 pgs.
Examination Report No. 2 in corresponding Australian Application No. 2013325106, dated Nov. 22, 2017, 5 pages.

* cited by examiner

CORROSION RESISTANT CONCRETE REINFORCING MEMBER

This application claims priority to International Application No. PCT/AU2013/001087 filed Sep. 20, 2013 and Australian Application No. 2012904199 filed Sep. 26, 2012; the entire contents of each are incorporated herein by reference.

FIELD OF THE INVENTION

The present invention relates generally to a corrosion resistant concrete reinforcing member. The present invention also relates to the use of a corrosion resistant concrete reinforcing member for strengthening concrete and to a system employing a corrosion resistant concrete reinforcing member.

BACKGROUND TO THE INVENTION

Concrete and other masonry or cementitious materials have high compressive strength, but relatively low tensile strength. When concrete is employed as a structural member it is common to employ reinforcing members to enhance the tensile strength of the final structure. Reinforcing members are most commonly made of steel or other metal reinforcing rods or bars, i.e., "rebar".

Although steel and other metal reinforcement can enhance the tensile strength of a concrete structure, they are susceptible to oxidation/corrosion. This oxidation can be increased by exposure to a strong acid, or otherwise lowering the pH of concrete. In addition, chlorine, from salt can permeate into concrete and cause corrosion. When the metal reinforcement corrodes, it can expand and create internal stresses in the concrete which can in turn lead to cracking and disintegration of the concrete. Once the structure of the concrete is compromised this further exposes the reinforcement material to corrosive compounds.

Corrosion resistant reinforcement members including polymer coated rod/rebar have been developed but fail to offer a simple, inexpensive and effective option to the traditional metal reinforcement solutions.

With the above in mind there is a need for improved reinforcing that does not suffer from one or more of the problems associated with existing solutions.

SUMMARY OF THE INVENTION

The present invention provides a corrosion resistant concrete reinforcing member comprising:

(i) an elongate core member defining a longitudinal axis;

(ii) a longitudinally extending outer wall connected to and extending around said elongate core; and (iii) a void between the elongate core and the outer wall that is in fluid communication with the outside of the reinforcement member;

wherein the surface area defined by the portions of the elongate core and the outer wall that define the void is adapted to contact concrete and assist in mechanical bonding of the reinforcing member to said concrete.

The present invention also provides a concrete reinforcing member comprising:

(i) an elongate core member defining a longitudinal axis;

(ii) a plurality of longitudinally extending outer walls connected to and extending around said elongate core; and (iii) a void between the elongate core and each outer wall that is in fluid communication with the outside of the reinforcement member;

wherein the surface area defined by the portions of the elongate core and the outer walls that define the void is adapted to contact concrete and assist in bonding of the reinforcing member into said concrete.

A corrosion resistant concrete reinforcing member of the present invention may be provided with its various components integrally provided i.e. as a one piece moulded unit.

In another aspect, the present invention provides a building reinforcement system comprising a corrosion resistant concrete reinforcing member of the invention.

In still another aspect, the present invention provides for the use of a corrosion resistant concrete reinforcing member for strengthening concrete.

DETAILED DESCRIPTION OF THE INVENTION

Figure 1:
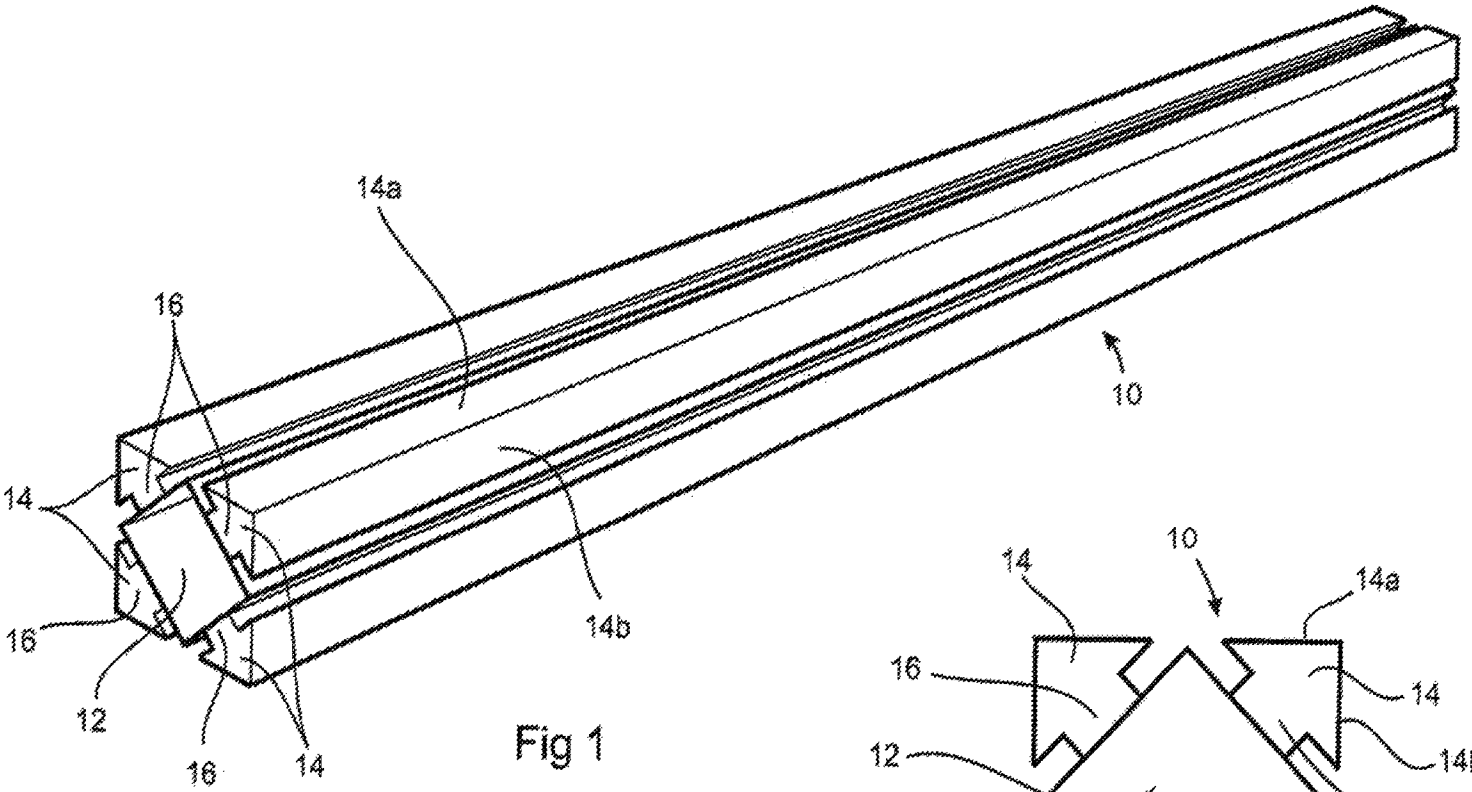
FIGS. 1 and 2 are isometric and cross-sectional views of a first embodiment of the concrete reinforcing member of the invention.

According to one embodiment, the present invention provides a corrosion resistant concrete reinforcing member comprising:

(i) an elongate core member defining a longitudinal axis;

(ii) a longitudinally extending outer wall connected to and extending around said elongate core; and (iii) a void between the elongate core and the outer wall that is in fluid communication with the outside of the reinforcement member;

wherein the surface area defined by the portions of the elongate core and the outer wall that define the void is adapted to contact concrete and assist in mechanical bonding of the reinforcing member to said concrete.

The corrosion resistant concrete reinforcing member may comprise a metal or alloy that is resistant to corrosion or a non-metallic material. Corrosion resistant metals and alloys include those comprising stainless steel, carbon steel, cast iron, bronze, nickel and/or chromium alloys such as durimet, monel and hasteloy, titanium and cobalt.

A preferred non-metallic material is a thermoplastic polymer. Thermoplastic polymers, as used herein, includes plastics which irreversibly solidify or "set" when completely cured. Preferably, the corrosion resistant concrete reinforcing member comprises a thermoplastic polymer selected from the group consisting of polyvinyl chloride, polyethylene and polypropylene, unsaturated polyester, phenolics, vinyl esters, polyvinylacetate, styrene-butadiene, polymethylmethacrylate, polystyrene, cellulose acetatebutyrate, saturated polyesters, urethane-extended saturated polyesters, methacrylate copolymers, polyethylene terephthalate and mixtures and blends thereof.

The corrosion resistant concrete reinforcing member may further comprise one or more additional components selected from the list comprising: reinforcing fillers, particulate fillers, selective reinforcements, thickeners, initiators, mould release agents, catalysts, pigments, flame retardants, and the like, in amounts commonly known to those skilled in the art. Any initiator may be a high or a low temperature polymerization initiator, or in certain applications, both may be employed. Catalysts are typically required in resin compositions thickened with polyurethane. The catalyst promotes the polymerization of NCO groups with OH groups. Suitable catalysts include dibutyl tin dilaurate and stannous octoate.

Preferably, the reinforcing member comprises a fibre reinforced polymer (FRP). When the reinforcing member includes an additional component it may be a reinforcing fibre material selected from the group comprising aramid, glass, carbon, basalt, metal, high modulus organic fibres (e.g., aromatic polyamides, polybenzimidazoles, and aromatic polyimides), other organic fibres (e.g., polyethylene, liquid crystal and nylon). Blends and hybrids of the various fibres can also be used. In this regard, the mechanical and thermal properties of the FRP depend on the amount and orientation of the fibres as well as the properties of the polymer matrix. As used herein, "concrete" is used in the usual sense of meaning a mixture of a particulate filler such as gravel, pebbles, sand, stone, slag or cinders in either mortar or cement. Exemplary cements include hydraulic cements such as Portland cement, aluminous cement, and the like. The cement or concrete may contain other ingredients such as, for example, a plastic latex, hydration aids, curatives, and the like.

The elongate core member can be solid or hollow. When the elongate core is hollow it may be hollow along its entire length or for only a part thereof. In this regard, a hollow core member allows for a lighter weight reinforcing member that has a greater circumference to cross-sectional area ratio, which allows for greater chemical bonding of the surface to the concrete. A hollow reinforcing member can also be more readily manipulated to allow for surface irregularities, such as indents or protrusions for improved mechanical interlocking into the concrete. When the elongate core member is hollow, the hollow core can serve as a conduit for other components such as wiring, monitoring instruments, other conduits and/or fluid.

The inner and outer surfaces of the elongate core member may be modified to further enhance bonding of the reinforcing member in concrete. In this regard, any modification that seeks to increase the surface area of the elongate core member for contact with concrete is likely to enhance bonding. Such modifications include indents, protrusions, scoring, channels and the like.

The inner and/or outer surfaces of the elongate core member may also be modified by the addition of a lining or coating of another material, such as a ceramic or silica that will further improve bonding between the reinforcing member and the concrete polymer. The liner or coating may also be formed of a plastic/polymer with different properties from the primary material used in the construction of the reinforcing member, that may alter the modulus of elasticity or another structural property or performance characteristic of the reinforcing member, as required.

Any modifications that create areas of increased cross section can also improve mechanical bonding with the concrete. Cross section variations can be accomplished by a range of methods including overmoulding or by employing a die of variable diameter in the extrusion, pultrusion or pushtrusion process. In this regard, by periodically increasing the diameter of the die, areas of increased diameter can be formed. Offset portions on the surface of the elongate core member can also increase mechanical bonding with, the concrete as well as providing raised surface features (protrusions) or recesses (indents).

When the elongate core is hollow it can also be filled with a material to achieve particular desired product characteristics such as thermoplastic polymer. In this regard, the hollow may be filled only at preselected portions of its length in order to provide localized strengthening without unduly increasing weight. Such filler material can provide increased shear strength at the centre of the length of the reinforcing member, and in sections that experience the greatest shear stresses.

The elongate core member can have a range of cross sectional shapes. Preferably, elongate core member has a round, oval or polygonal cross section. The cross sectional shape of the elongate core member may also be semi-circular ("half-moon") or semi oval and thus include a substantially flat outer face. When the cross sectional shape is polygonal it may be triangular, square or rectangular. When the elongate core member is provided integrally with the outer wall its cross sectional shape is less well defined. Embodiments of the present invention including a "one piece" or integral elongate core member and outer wall, and optionally a flange member, are described in more detail later herein.

The elongate core member can have a range of cross sectional sizes. Preferably, elongate core member has an internal diameter or width of at least 3, 4, 5, 6, 7.5 or 8 cm but other dimensions are possible depending on the required performance of the end product.

The longitudinally extending outer wall can be directly or indirectly connected with the elongate core member. When the outer wall is indirectly connected to the elongate core member it may be connected via a flange member that extends from and along the longitudinal axis of the elongate core member.

Preferably, there is a plurality of outer walls. Thus, the present invention also provides a concrete reinforcing member comprising:

(i) an elongate core member defining a longitudinal axis;
(ii) a plurality of longitudinally extending outer walls connected to and extending around said elongate core; and
(iii) a void between the elongate core and each outer wall that is in fluid communication with the outside of the reinforcement member;

wherein the surface area defined by the portions of the elongate core and the outer walls that define the void is adapted to contact concrete and assist in bonding of the reinforcing member into said concrete.

When there are multiple outer walls there may be multiple flange members connecting each outer wall to the elongate core member.

The flange member may be varied and includes a rib member. The flange member may be of various profiles, shapes and sizes selected to suit the particular use requirements.

At least one of the surfaces of the flange member may have a non-planar surface portion for improving concrete adhesion thereto. In addition, certain parts of the flange member may be thicker than the other portions. Typically, each flange member has a constant cross section. In addition, the surfaces of the flange member may be modified to further enhance bonding of the reinforcing member in concrete. In this regard, any modification that seeks to increase the surface area of the flange member for contact with concrete is likely to enhance bonding. Such modifications include indents, protrusions, scoring, channels and the like. Preferably, each flange member has a cross sectional dimension about the same (or greater than the elongate core member.

When there is a plurality of outer walls there is preferably, two, three, or four longitudinally extending outer walls connected to elongate core member. Even more preferably, the plurality of outer walls are equidistantly spaced around the elongate core member.

The inner and outer surfaces of the outer walls may be modified to further enhance bonding of the reinforcing member in concrete. In this regard, any modification that seeks to increase the surface area of the outer walls for contact with concrete is likely to enhance bonding. Such modifications include indents, protrusions, scoring, channels and the like and are described further elsewhere herein.

The outer wall can have a range of cross sectional shapes. The outer wall may be angular or curved. Preferably, the outer wall has a V, L, triangular or convex cross section. It will be appreciated that the outer walls also dictate the outer cross sectional shape of the concrete reinforcing member. Preferably, the outer cross sectional shape is generally circular, oval or polygonal, such as triangular, square or rectangular. The outer cross-sectional shape of the concrete reinforcing member may be varied but it is preferable that it has a constant cross-sectional shape along its length.

The outer wall can have a range of sizes depending on the use requirements and how many outer walls are employed.

The void defines a space for receiving concrete and thus acts to assist in mechanical bonding of the reinforcing member to said concrete. In this regard, the void increases the surface area for bonding per unit of cross sectional area and/or per unit of volume of the reinforcing member. Preferably, the inclusion of the void increases the surface area for bonding per 1 cm of length of the reinforcing member by at least 1.25×, 1.5×, 1.75× or 2× relative to a reinforcing member with the same general cross sectional profile but without the void.

The void between the elongate core and the outer wall that is in fluid communication with the outside of the reinforcement member may have a range of shapes and sizes depending on the shape and configuration of the elongate core member, outer walls and flange member, when present. Preferably, the edge of the outer wall adjacent to the opening to the void includes a projection or lip that further enhances the mechanical bonding between the reinforcing member and the concrete. The size of the opening to the void may be varied depending on the size of the aggregate in the concrete. Preferably, the opening is large enough to allow the passage of aggregate of a width of at least 2.5 or 3.5 cm.

Preferably, the corrosion resistant concrete reinforcing member is moulded as a one piece unit and thus can include any one or more of the features described above provided integrally. Thus, the present invention also provides a corrosion resistant concrete reinforcing member comprising the following components, integrally provided:

(i) an elongate core member defining a longitudinal axis;
(ii) a longitudinally extending outer wall connected to and extending around said elongate core; and
(iii) a void between the elongate core and the outer wall that is in fluid communication with the outside of the reinforcement member;

wherein the surface area defined by the portions of the elongate core and the outer wall that define the void is adapted to contact concrete and assist in bonding of the reinforcing member into said concrete.

When the corrosion resistant concrete reinforcing member is moulded as a one piece unit it can have a variety of outer and inner cross sectional shapes. The outer cross sectional shapes include those described above. With respect to inner cross sectional shapes they include generally "cross" or "X" shaped where the centre of the X represents the elongate core member and the arms or legs of the X represent the flange members connecting the elongate core member to the outer walls.

Manufacture

The reinforcing member of the present invention can be produced using a range of techniques including extrusion, pultrusion, pushtrusion. Different techniques may be used to manufacture different components of the reinforcing member and then the components can be assembled by the use of suitable bonding agent. For example, the elongate core may be manufactured using a filament winding technique and the longitudinally extending outer wall may be formed by extrusion, pultrusion or pushtrusion. Alternatively, the reinforcing member may be manufactured as a single piece from a single manufacturing process such as extrusion, pultrusion or pushtrusion.

Other Components

The reinforcing member of the invention is used in much the same manner as conventional reinforcement members/bars are used. The reinforcing members can be assembled into place, forming a skeleton or framework over which the concrete structure is formed. Individual reinforcing member can be connected together in a variety of ways, including ties, clamps, welds, brackets, snap-on bridges, strips, hooks or other connectors, glues, and the like, to hold them in place until the concrete is poured and hardens. In preferred embodiments, the concrete is poured over the skeleton or framework and permitted to harden.

Thus, in another embodiment the present invention provides a system comprising a reinforcement member of the present invention and at least on other component selected from the list comprising: a support member such as a chair, a brace, an end cap, a tie member and a base member.

General

Those skilled in the art will appreciate that the invention described herein is susceptible to variations and modifications other than those specifically described. The invention includes all such variation and modifications. The invention also includes all of the steps and features referred to or indicated in the specification, individually or collectively and any and all combinations or any two or more of the steps or features.

Each document, reference, patent application or patent cited in this text is expressly incorporated herein in their entirety by reference, which means that it should be read and considered by the reader as part of this text. That the document, reference, patent application or patent cited in this text is not repeated in this text is merely for reasons of conciseness. None of the cited material or the information contained in that material should, however be understood to be common general knowledge.

The present invention is not to be limited in scope by any of the specific embodiments described herein. These embodiments are intended for the purpose of exemplification only. Functionally equivalent products and methods are clearly within the scope of the invention as described herein.

The invention described herein may include one or more range of values (e.g. size etc). A range of values will be understood to include all values within the range, including the values defining the range, and values adjacent to the range which lead to the same or substantially the same outcome as the values immediately adjacent to that value which defines the boundary to the range.

Throughout this specification, unless the context requires otherwise, the word "comprise" or variations such as "comprises" or "comprising", will be understood to imply the inclusion of a stated integer or group of integers but not the exclusion of any other integer or group of integers.

Other definitions for selected terms used herein may be found within the detailed description of the invention and apply throughout. Unless otherwise defined, all technical terms used herein have the same meaning as commonly understood to one of ordinary skill in the art to which the invention belongs.

Description of the Preferred Embodiments

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 2:
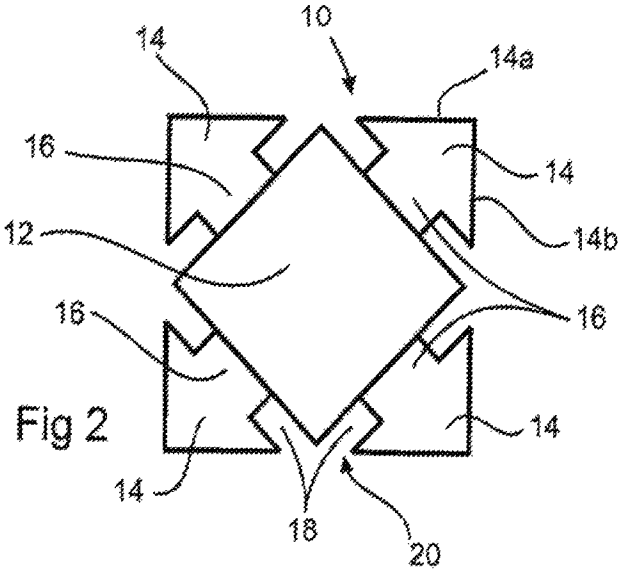

FIGS. 1 and 2 illustrate a first embodiment of the invention where the concrete reinforcing member, generally indicated by the numeral 10 has a generally square outer cross section and includes a hollow elongate core 12 with a generally square cross section. Four longitudinally extending outer walls 14 have a generally triangular cross section and hence each define outer wall faces 14*a* and 14*b*. Each outer wall 14 is connected to, equidistantly spaced and extending around the elongate core 12. The outer wall faces 14*a* and 14*b* define an angular outer surface and are indirectly connected to the elongate core 12 via flange members in the form of rib members 16 that extend from and along a longitudinal surface of the elongate core 12 and have width that is less than the width of said longitudinal surface. The elongate core 12 and the outer walls 14 together define voids 18 that are in fluid communication with the outside of the reinforcement member via openings 20. In use, the surface area defined by the outer walls 14, the rib members 16 and the elongate core 12 aid in "bonding" of the concrete reinforcing member into concrete.

Figure 3:
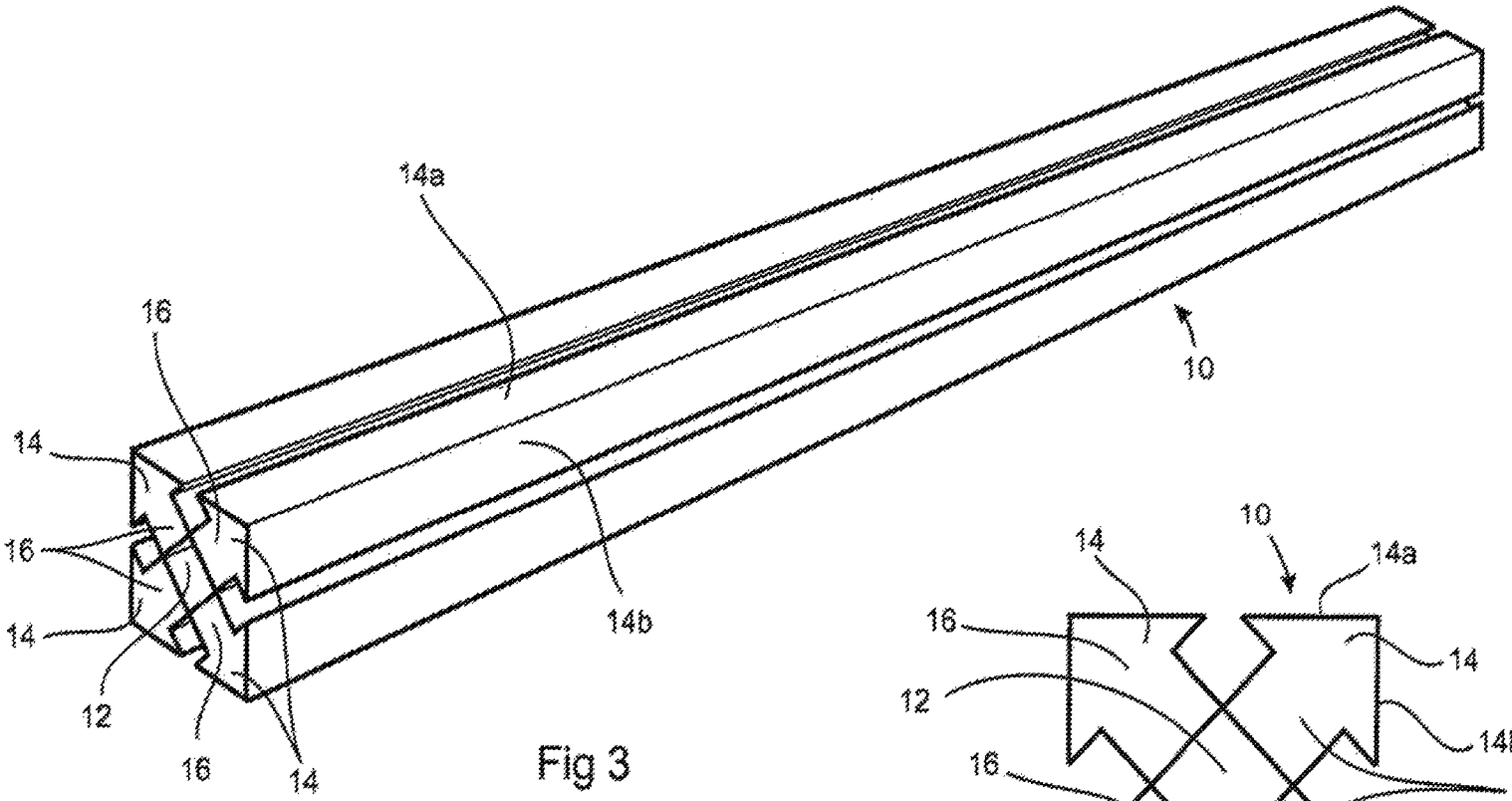
FIGS. 3 and 4 are isometric and cross-sectional views of a second embodiment of the concrete reinforcing member of the invention.
Figure 4:
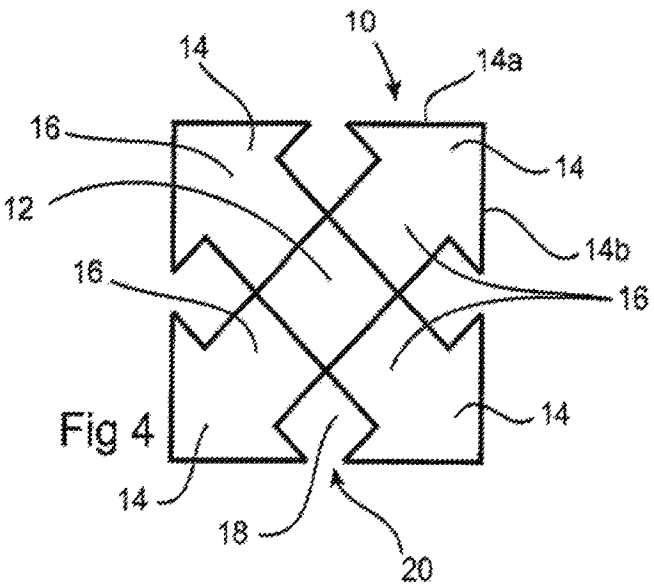

FIGS. 3 and 4 illustrate a second embodiment of the invention where the concrete reinforcing member, generally indicated by the numeral 10 has a generally square outer cross section and includes a hollow elongate core 12 with a generally square cross section, that is smaller in terms of cross sectional area than the first embodiment. Four longitudinally extending outer walls 14 have a generally triangular cross section and hence each define outer wall faces 14*a* and 14*b*. As in the first embodiment, the outer wall faces 14*a* and 14*b* define an angular outer surface and are indirectly connected to the elongate core 12 via flange members in the form of rib members 16 that extend from and along a longitudinal surface of the elongate core 12 and have width that is less than the width of said longitudinal surface. The elongate core 12 and the outer walls 14 together define voids 18 that are in fluid communication with the outside of the reinforcement member via openings 20.

Figure 5:
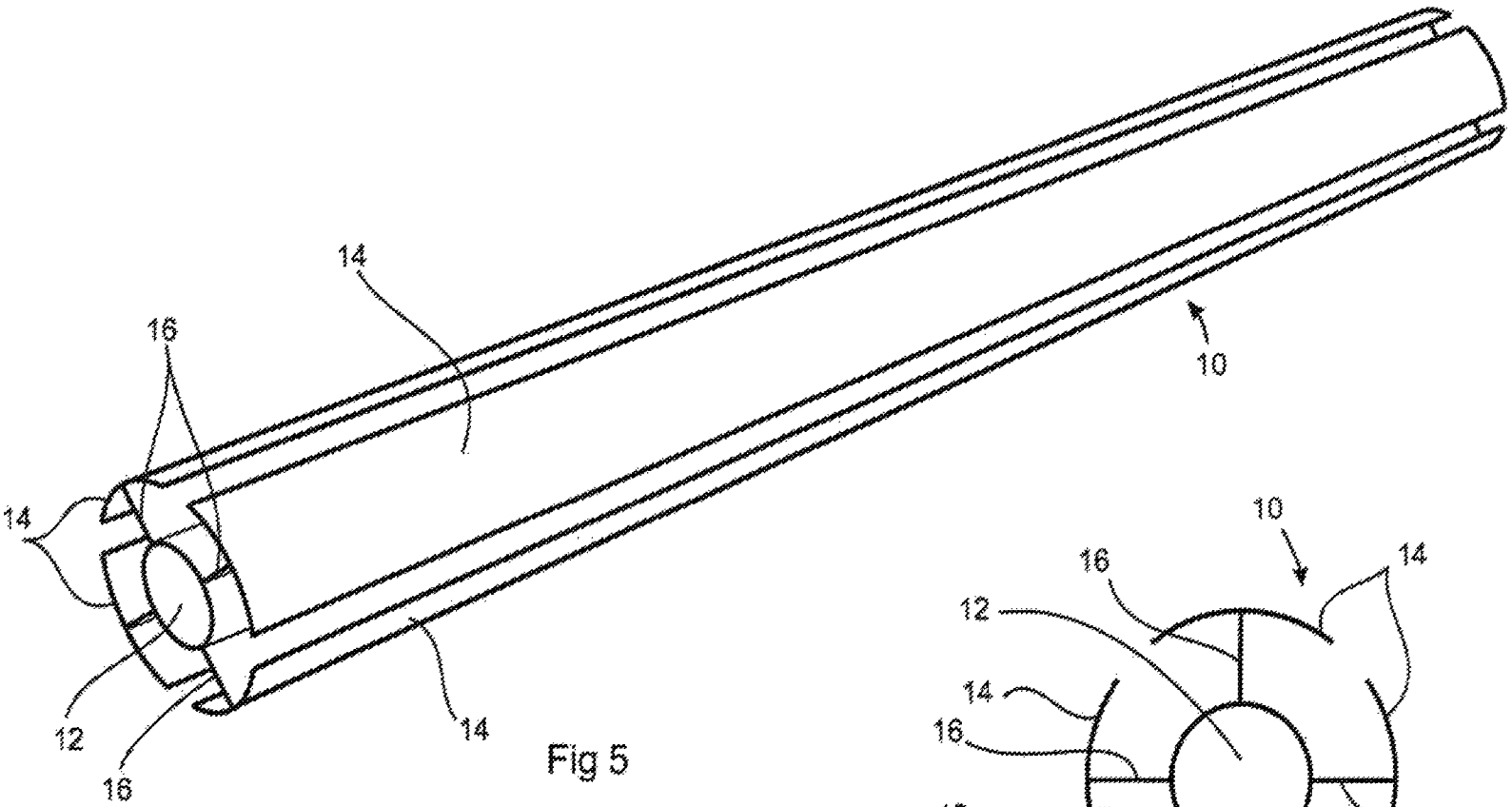
FIGS. 5 and 6 are isometric and cross-sectional views of a third embodiment of the concrete reinforcing member the invention.
Figure 6:
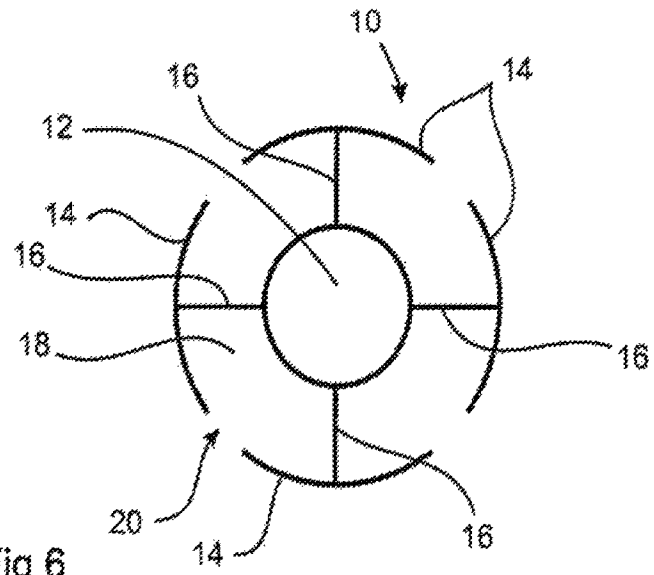

FIGS. 5 and 6 illustrate a third embodiment of the invention where the concrete reinforcing member, generally indicated by the numeral 10 has a generally circular outer cross section and includes a hollow elongate core 12 that has a generally circular cross section and four longitudinally extending outer walls 14 connected to, equidistantly spaced and extending around the elongate core 12.

The outer walls 14 have an arcuate cross section defining a convex outer surface and are indirectly connected to the elongate core 12 via flange members in the form of rib members 16 that extend from and along the longitudinal axis of the elongate core 12. The elongate core 12 and the outer walls 14 together define voids 18 that are in fluid communication with the outside of the reinforcement member via openings 20.

Concrete reinforcing members according to the third embodiment formed from glass fibre reinforced polymer (and in 4×1 m lengths) were supported at both ends and load tested and demonstrated to have a load capacity of between 6.25 kN-11.6 kN with a minimal average displacement of 4 mm.

Figure 7:
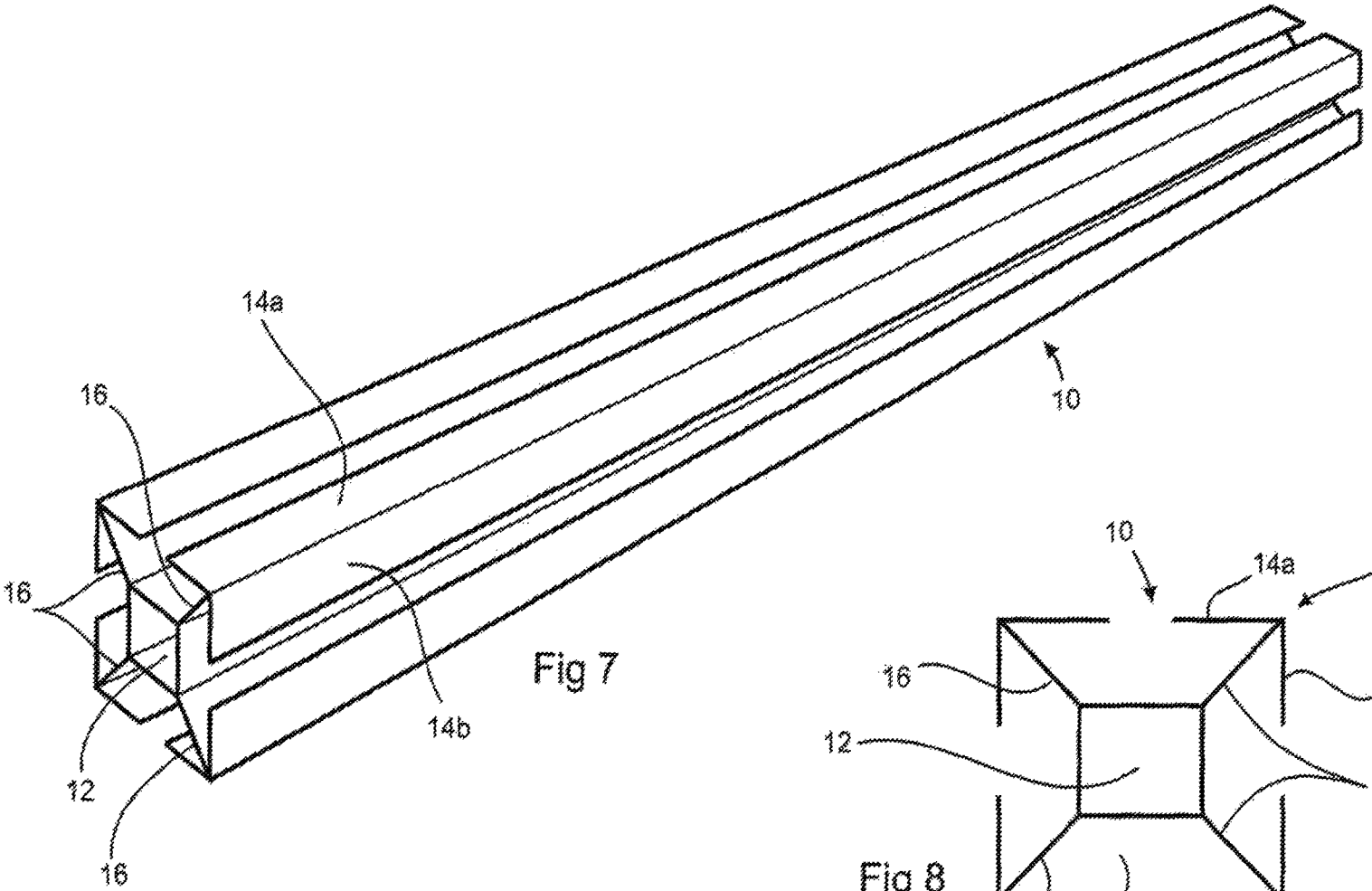
FIGS. 7 and 8 are isometric and cross-sectional views of a fourth embodiment of the concrete reinforcing member the invention.
Figure 8:
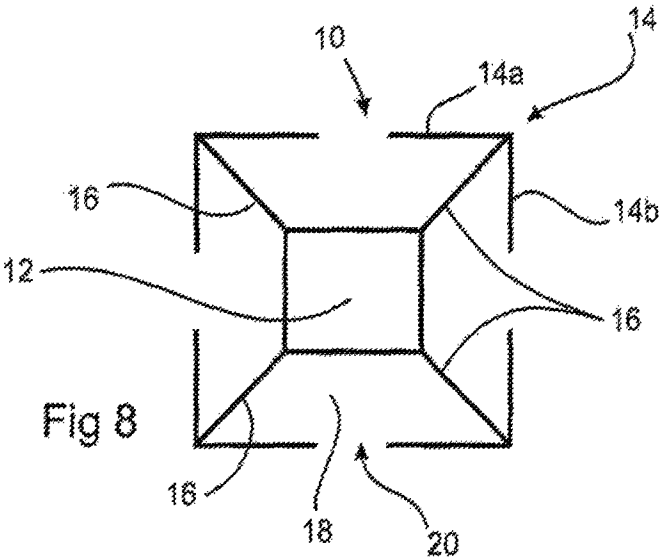

FIGS. 7 and 8 illustrate a fourth embodiment of the invention where the concrete reinforcing member, generally indicated by the numeral 10 has a generally square outer cross section and includes a hollow elongate core 12 with a generally square cross section and four longitudinally extending outer walls 14 connected to, equidistantly spaced and extending around the elongate core 12. Each outer wall 14 has an "L" shaped cross section, defining two angular outer wall faces 14*a* and 14*b* and are indirectly connected to the elongate core 12 via flange members in the form of rib members 16 that extend from the corners of and along the longitudinal axis of the elongate core 12. The elongate core 12 and the outer walls 14 together define voids 18 that are in fluid communication with the outside of the reinforcement member via openings 20.

Figure 9:
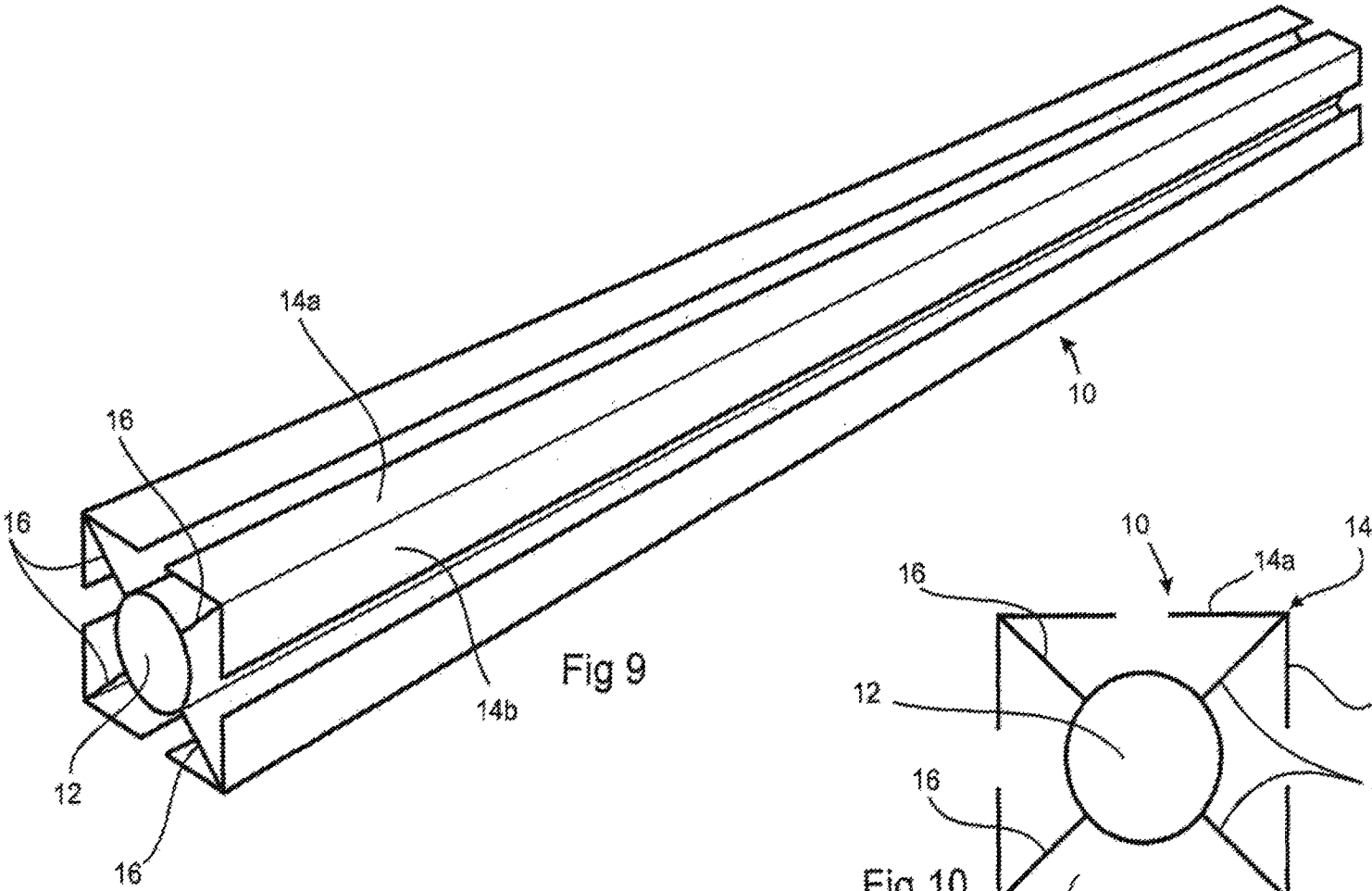
FIGS. 9 and 10 are isometric and cross-sectional views of a fifth embodiment of the concrete reinforcing member of the invention.
Figure 10:
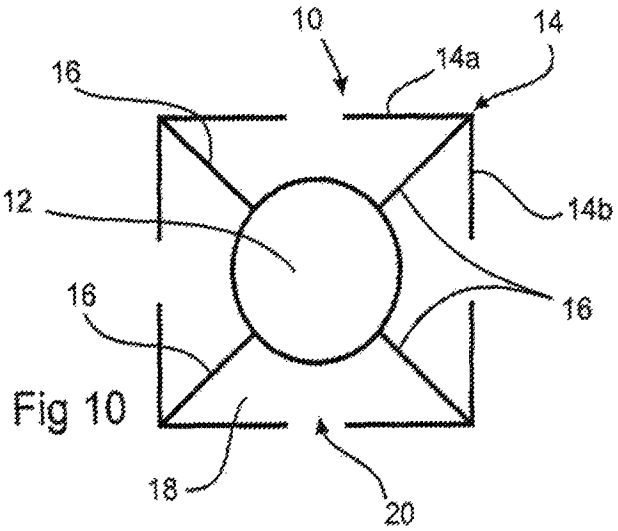

FIGS. 9 and 10 illustrate a fifth embodiment of the invention where the concrete reinforcing member, generally indicated by the numeral 10 has a generally square outer cross section and includes a hollow elongate core 12 with a generally circular cross section and four longitudinally extending outer walls 14 connected to, equidistantly spaced and extending around the elongate core 12. Each outer wall 14 has an "L" shaped cross section, defining two angular outer wall faces 14*a* and 14*b* and are indirectly connected to the elongate core 12 via flange members in the form of rib members 16 that extend from the corners of and along the longitudinal axis of the elongate core 12. The elongate core 12 and the outer walls 14 together define voids 18 that are in fluid communication with the outside of the reinforcement member via openings 20.

Figure 11:
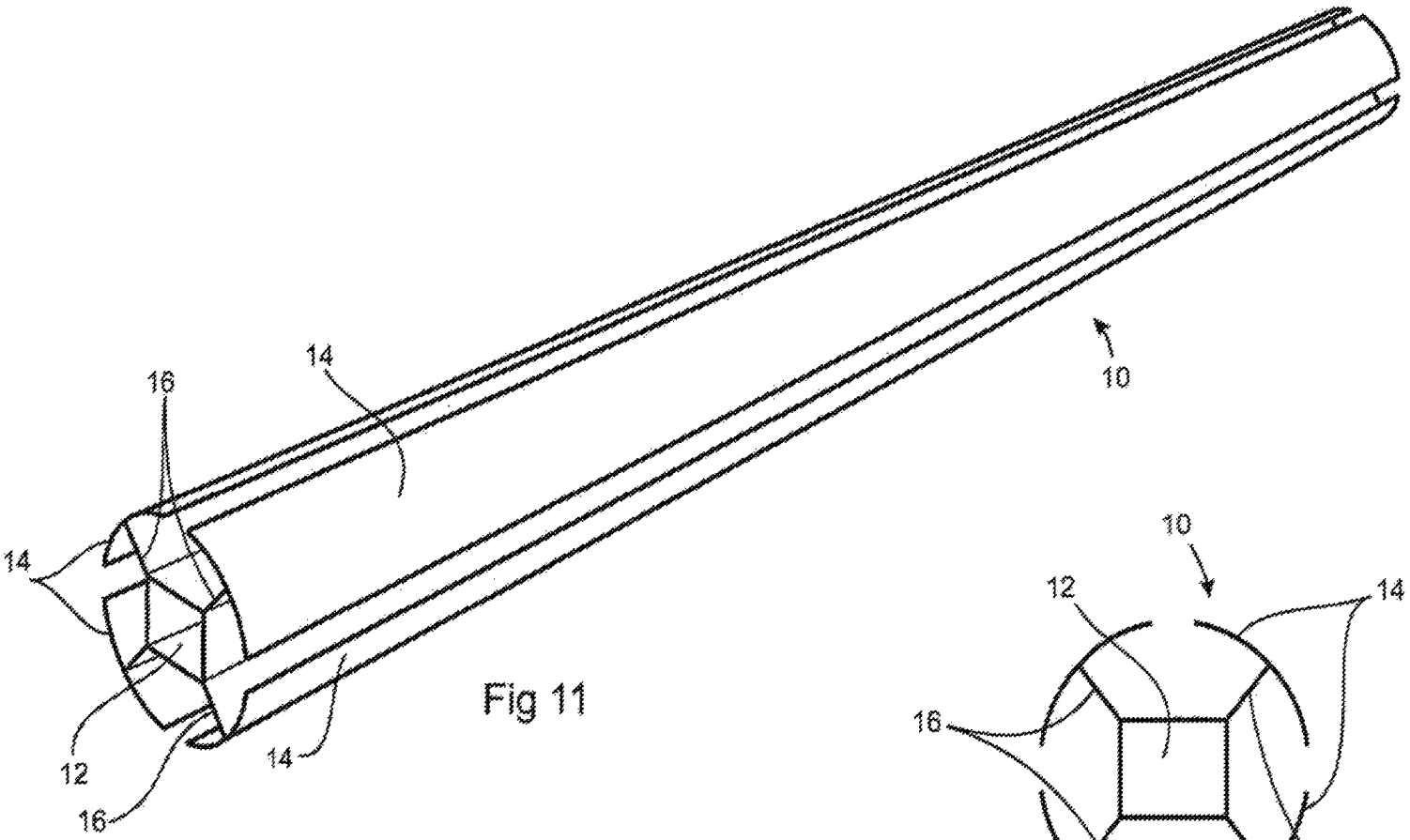
FIGS. 11 and 12 are isometric and cross-sectional views of a sixth embodiment of the concrete reinforcing member of the invention.
Figure 12:
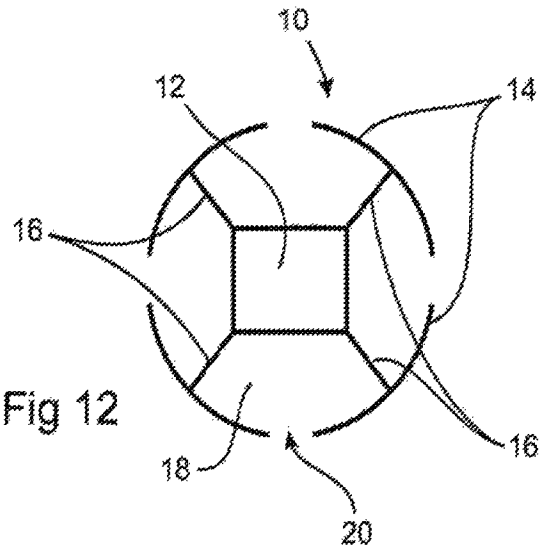

FIGS. 11 and 12 illustrate a sixth embodiment of the invention where the concrete reinforcing member, generally indicated by the numeral 10 has a generally circular cross section and includes a hollow elongate core 12 with a generally square cross section and four longitudinally extending outer walls 14 connected to, equidistantly spaced and extending around the elongate core 12.

The outer walls 14 have an arcuate cross section defining a convex outer surface and are indirectly connected to the elongate core 12 via flange members in the form of rib members 16 that extend from the corners of and along the longitudinal axis of the elongate core 12. The elongate core 12 and the outer walls 14 together define voids 18 that are in fluid communication with the outside of the reinforcement member via openings 20.

Figure 13:
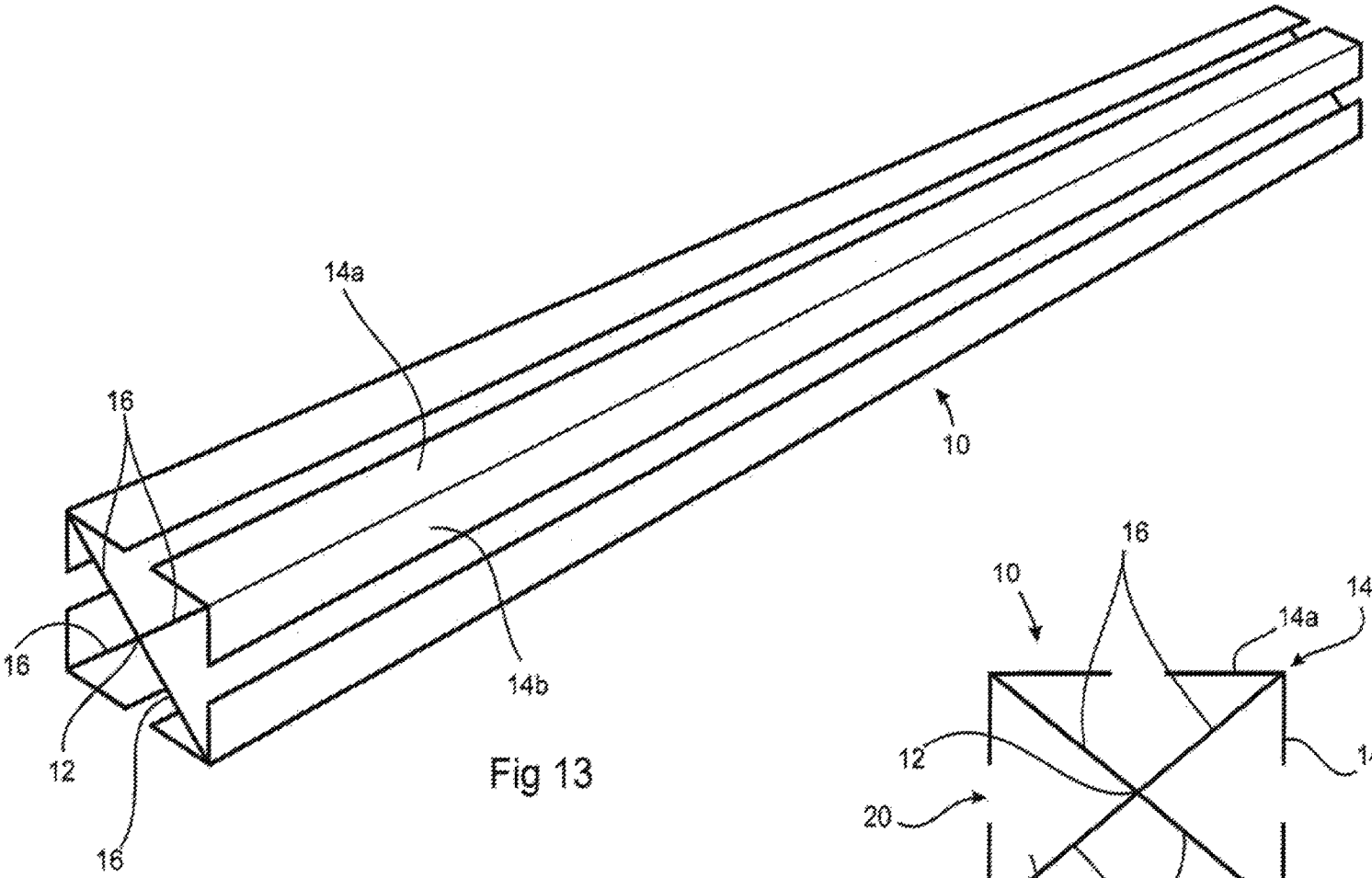
FIGS. 13 and 14 are isometric and cross-sectional views of a seventh embodiment of the concrete reinforcing member of the invention.
Figure 14:
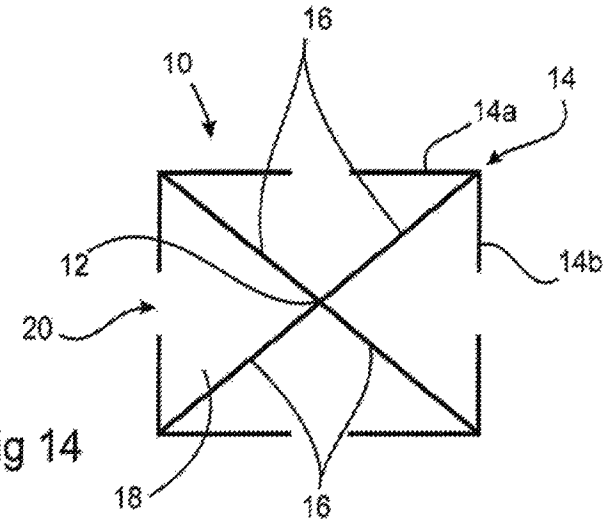

FIGS. 13 and 14 illustrate a seventh embodiment of the invention where the concrete reinforcing member, generally indicated by the numeral 10 has a generally square outer cross section and includes a solid elongate core 12, defined by the intersection of the flange members in the form of rib members 16 that form a generally X shaped cross section and extend out to indirectly connect the elongate core 12 to the four longitudinally extending outer walls 14. The outer walls 14 have an "L" shaped cross section, defining two angular outer wall faces 14*a* and 14*b* and are indirectly connected to the elongate core 12 via flange members in the form of rib members 16 that extend from the corners of and along the longitudinal axis of the elongate core 12. The elongate core 12 and the outer walls 14 together define voids 18 that are in fluid communication with the outside of the reinforcement member via openings 20.

Figure 15:
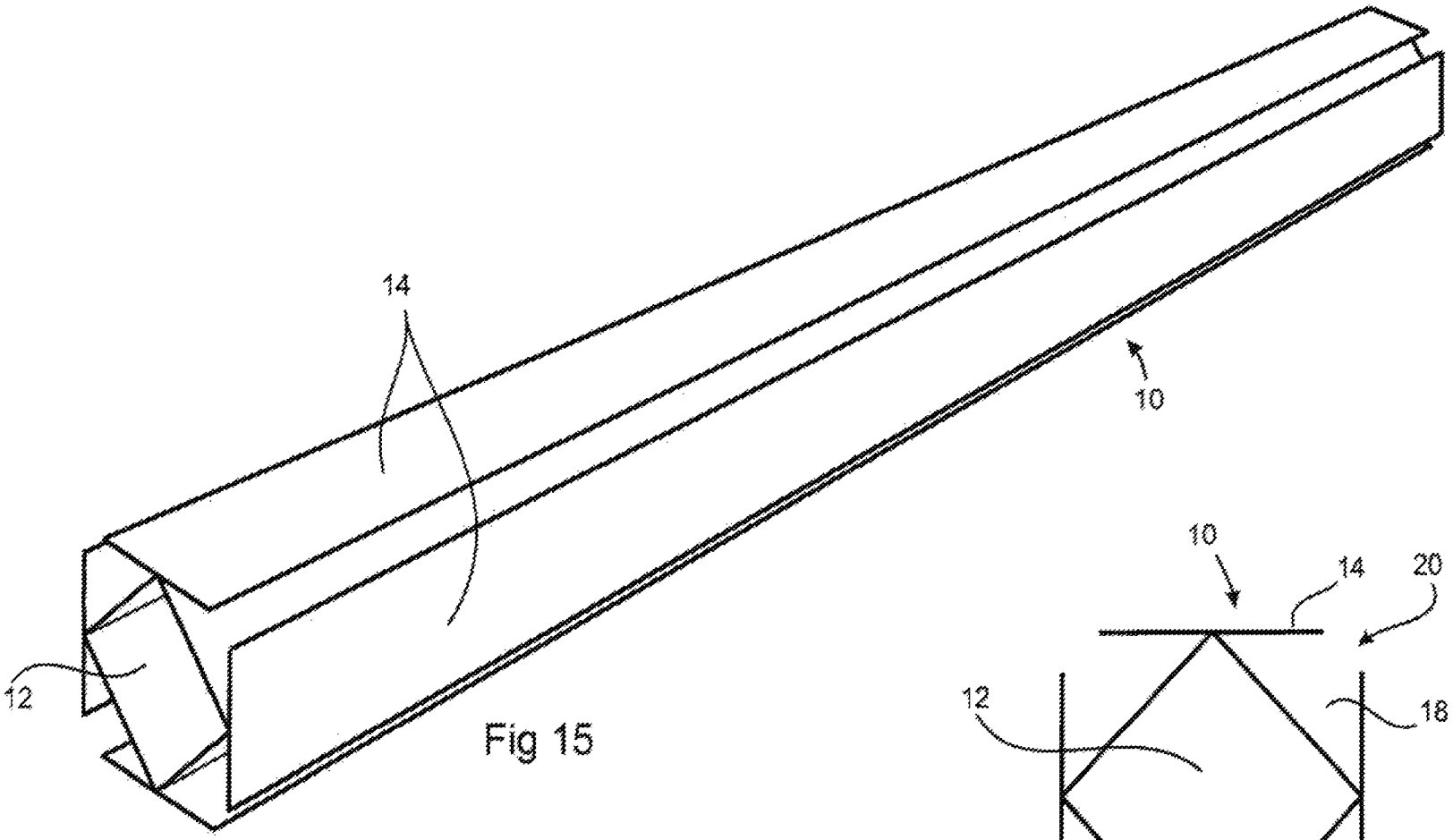
FIGS. 15 and 16 are isometric and cross-sectional views of an eighth embodiment of the concrete reinforcing member of the invention.
Figure 16:
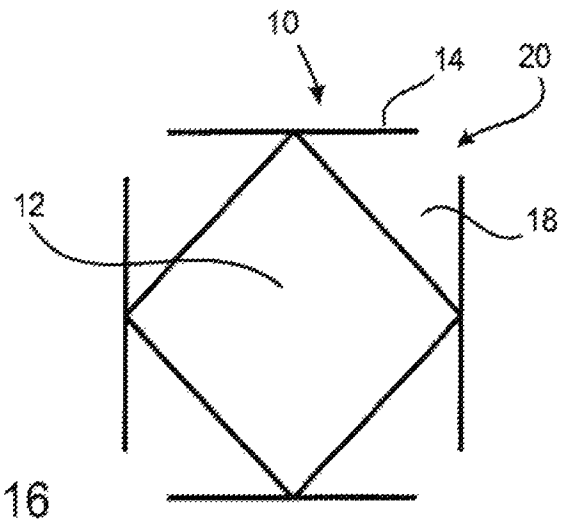

FIGS. 15 and 16 illustrate a eighth embodiment of the invention where the concrete reinforcing member, generally indicated by the numeral 10 has a generally square outer cross section and, includes a hollow elongate core 12 with a generally square cross section and four longitudinally extending outer walls 14, equidistantly spaced and extending around the elongate core. The outer walls 14 are directly attached to the elongate core at its corner edges and define a flat outer surface. The elongate core 12 and the outer walls 14 together define voids 18 that are in fluid communication with the outside of the reinforcement member via openings 20.

Figure 17:
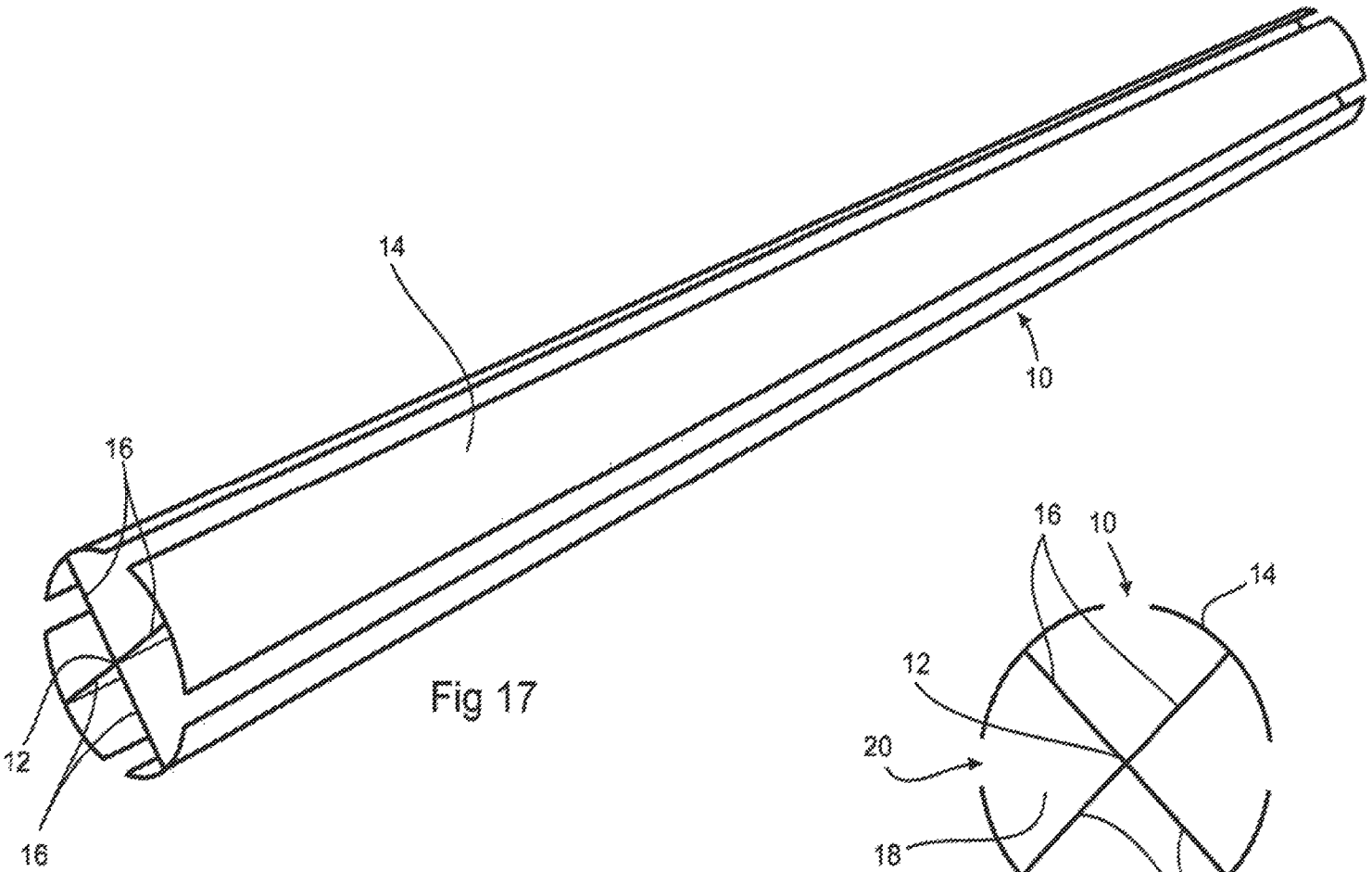
FIGS. 17 and 18 are isometric and cross-sectional views of a ninth embodiment of the concrete reinforcing member of the invention.
Figure 18:
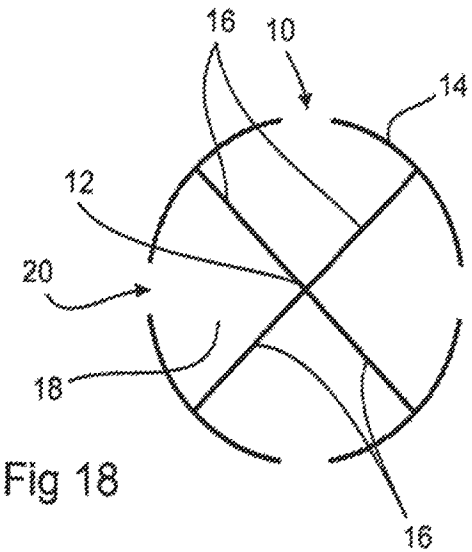

FIGS. 17 and 18 illustrate a ninth embodiment of the invention where the concrete reinforcing member, generally indicated by the numeral 10 and has a generally circular outer cross section and includes a solid elongate core 12, defined by the intersection of the flange members in the form of rib members 16 that form a generally X shaped cross section and extend out to indirectly connect the elongate core 12 to the four longitudinally extending outer walls 14. The outer walls 14 have an arcuate shaped cross section defining a convex outer surface. The elongate core 12 and the outer walls 14 together define voids 18 that are in fluid communication with the outside of the reinforcement member via openings 20.

Figure 19:
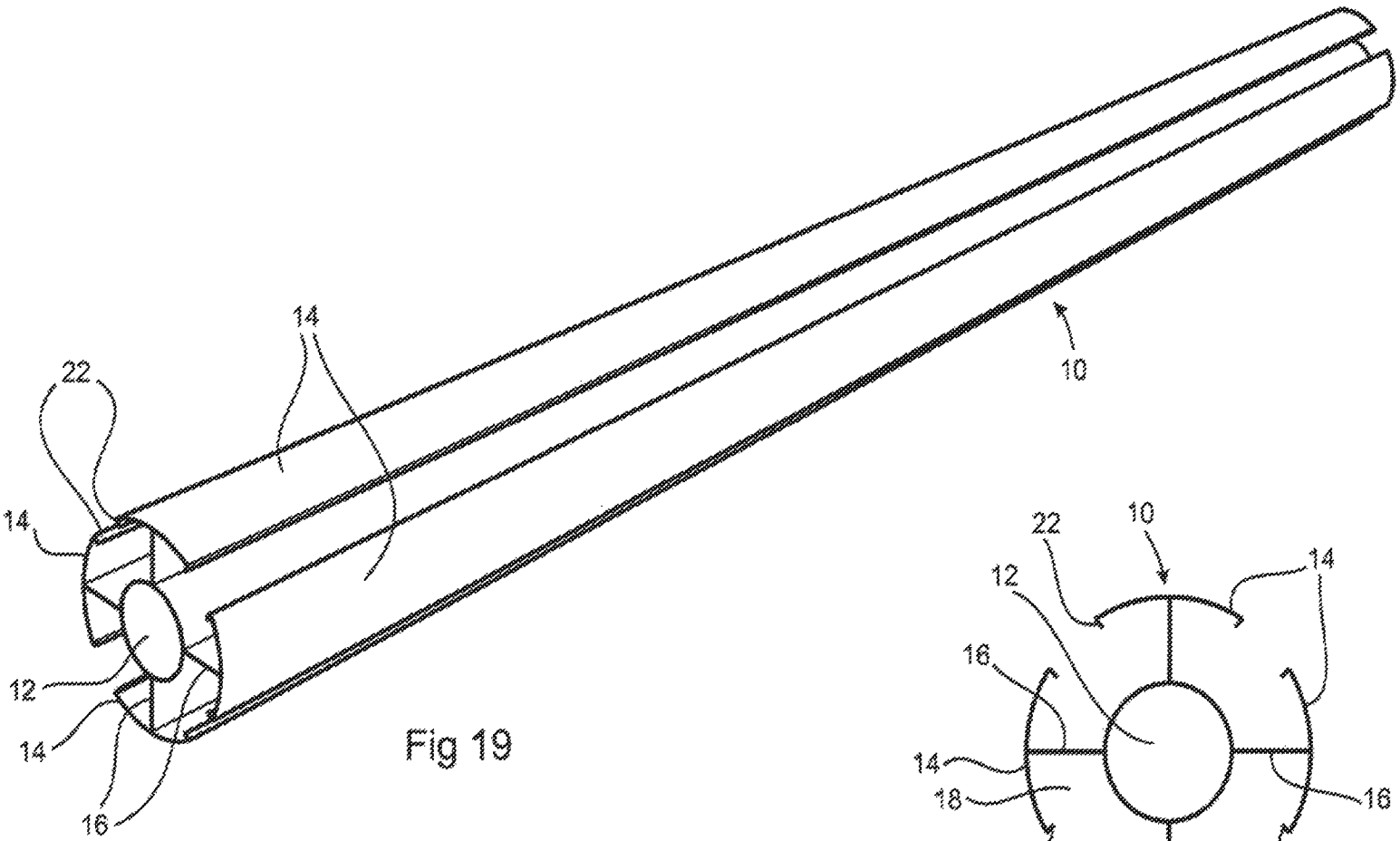
FIGS. 19 and 20 are isometric and cross-sectional views of a tenth embodiment of the concrete reinforcing member of the invention incorporating lip members.
Figure 20:
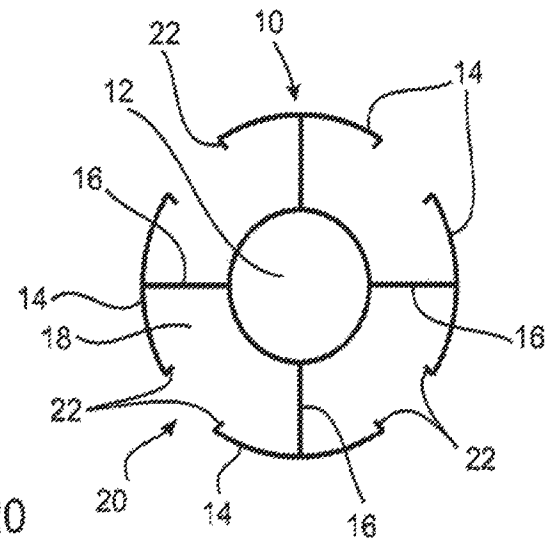

FIGS. 19 and 20 illustrate a tenth embodiment of the invention that is similar to the third embodiment and corresponding numbering has been used. The tenth embodiment includes outer walls 14 that further comprise lip members 22 provided at the edge of the outer walls 14 adjacent to the opening 20 to the void 18. The lip member 22 provide additional contact surfaces and also act to further contain the concrete in the void 18 to further enhance the mechanical bonding between the reinforcing member and the concrete.

Figure 21:
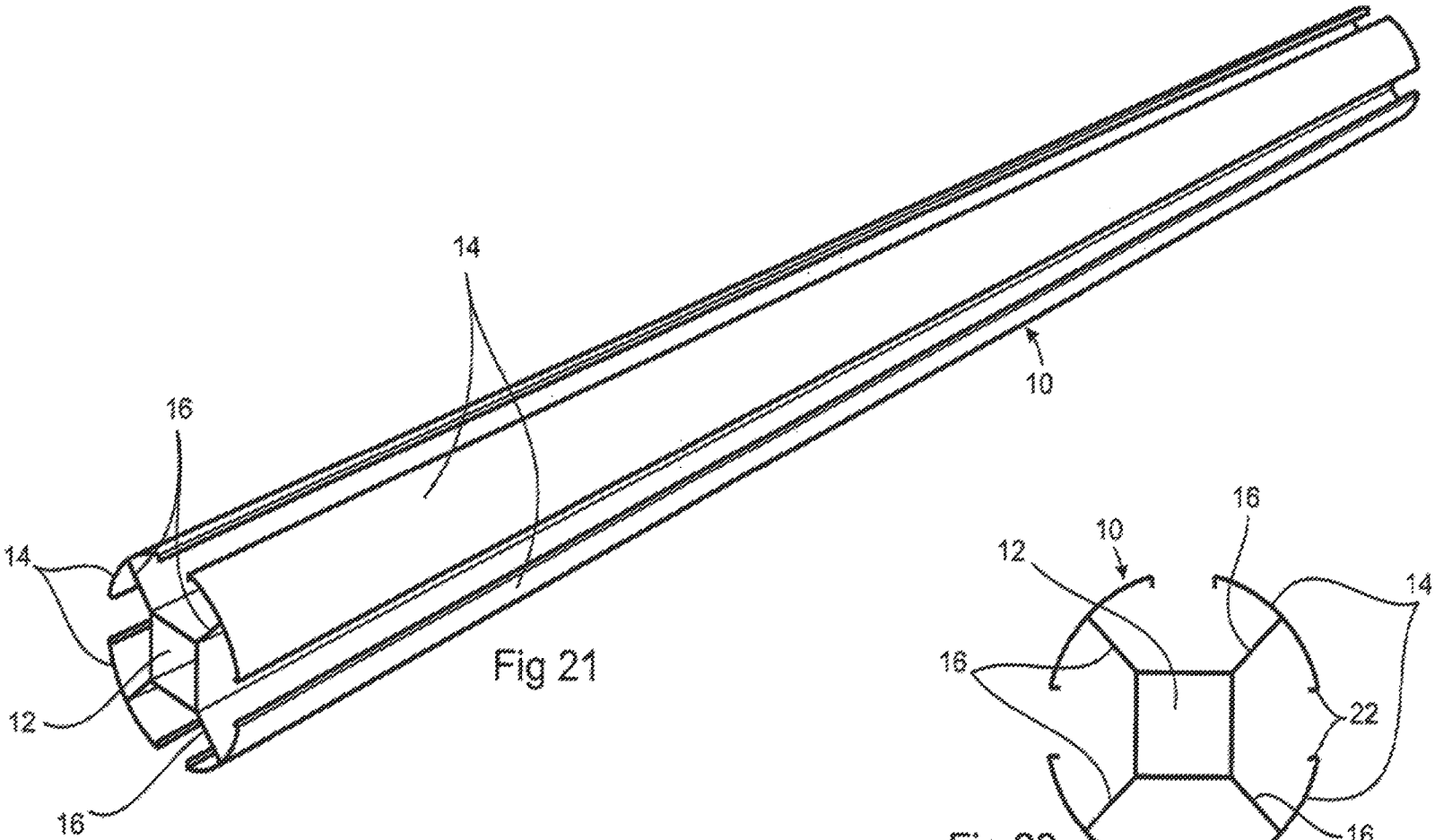
FIGS. 21 and 22 are isometric and cross-sectional views of an eleventh embodiment of the concrete reinforcing member of the invention incorporating lip members.
Figure 22:
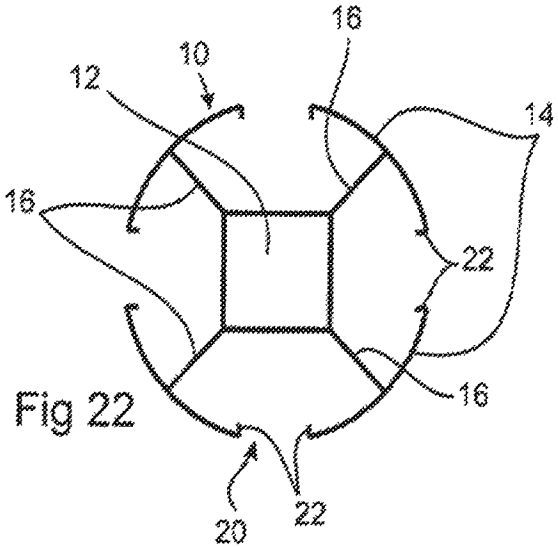

FIGS. 21 and 22 illustrate an eleventh embodiment of the invention that is similar to the sixth embodiment and corresponding numbering has been used. The eleventh embodiment includes outer walls 14 that further comprise lip members 22 provided at the edge of the outer walls 14 adjacent to the opening 20 to the void 18. The lip member 22 provide additional contact surfaces and also act to further contain the concrete in the void 18 to further enhance the mechanical bonding between the reinforcing member and the concrete.

Figure 23:
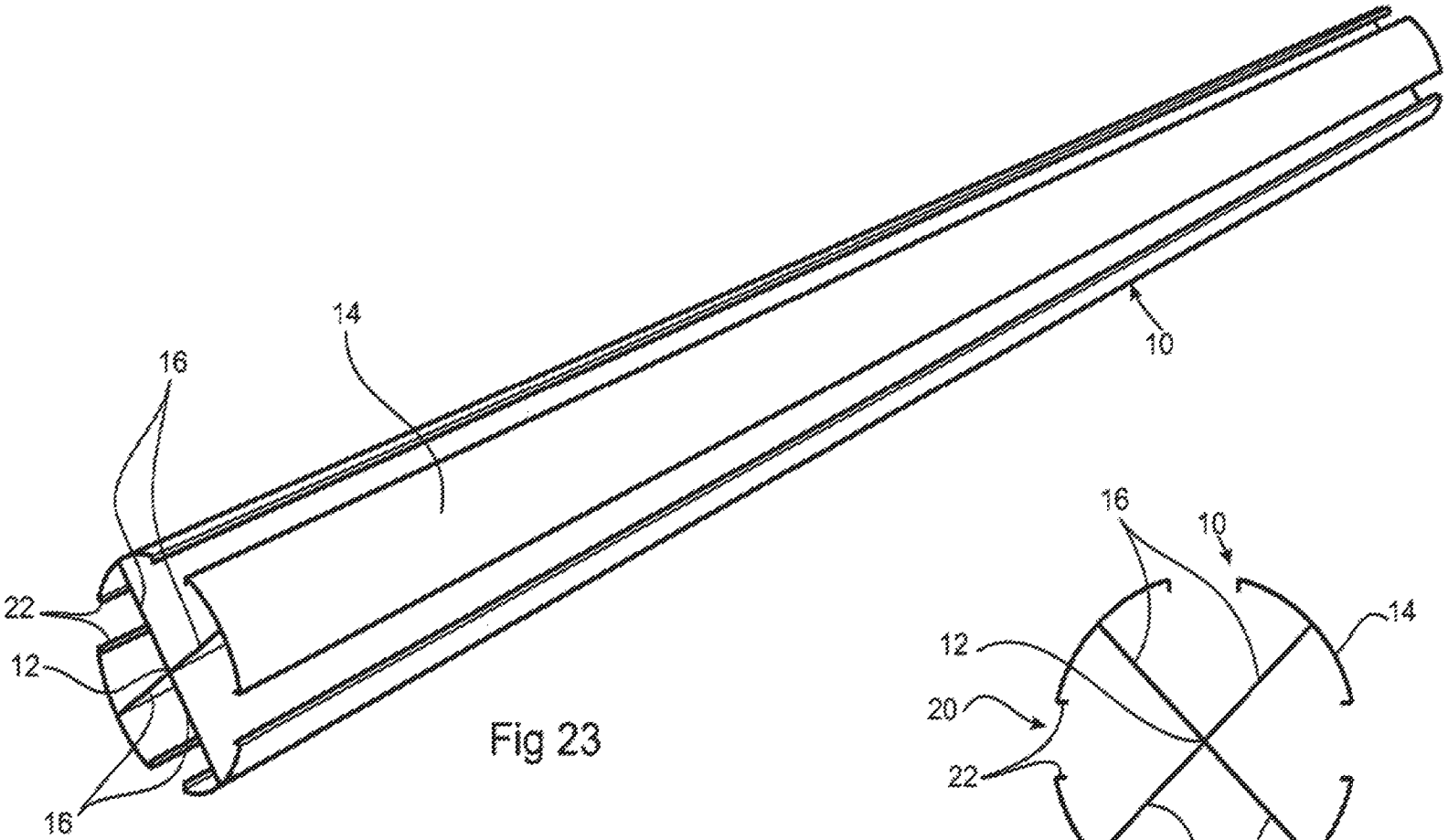
FIGS. 23 and 24 are isometric and cross-sectional views of a twelfth embodiment of the concrete reinforcing member of the invention incorporating lip members.
Figure 24:
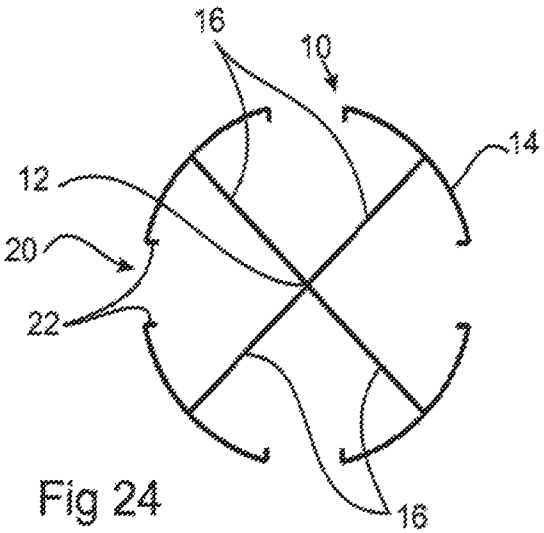

FIGS. 23 and 24 illustrate a twelfth embodiment of the invention that is similar to the ninth embodiment and corresponding numbering has been used. The twelfth embodiment includes outer walls 14 that further comprise lip members 22 provided at the edge of the outer walls 14 adjacent to the opening 20 to the void 18. The lip member 22 provide additional contact surfaces and also act to further contain the concrete in the void 18 to further enhance the mechanical bonding between the reinforcing member and the concrete.

Figure 25:
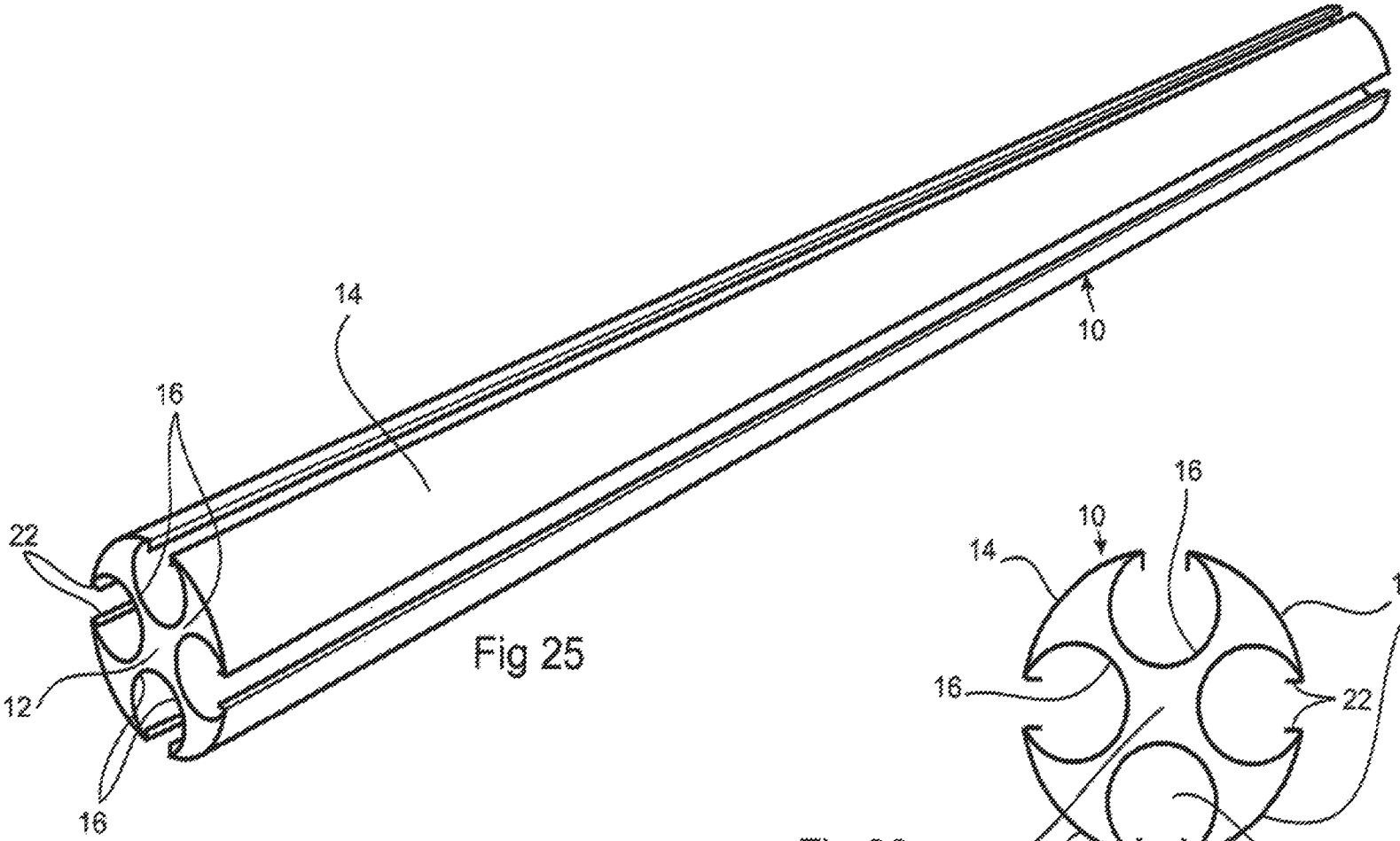
FIGS. 25 and 26 are isometric and cross-sectional views of a thirteenth embodiment of the concrete reinforcing member of the invention incorporating lip members.
Figure 26:
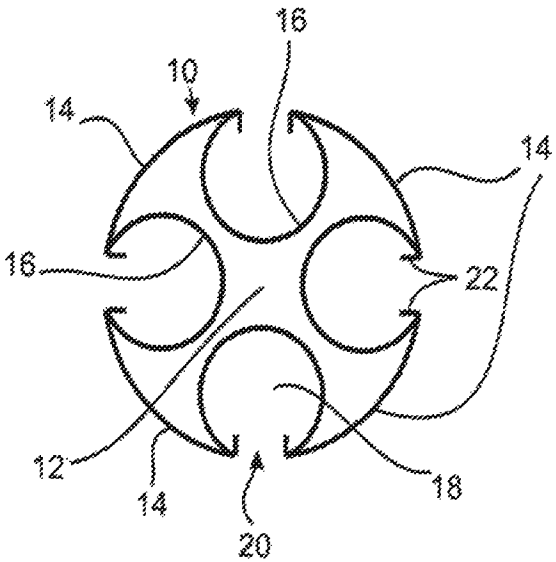

FIGS. 25 and 26 illustrate a thirteenth embodiment of the invention where the concrete reinforcing member, generally indicated by the numeral 10 has a generally circular outer cross section and includes a solid elongate core 12 provided integrally with four longitudinally extending outer walls 14 that define a convex outer wall surface. The core 12 and outer walls 14 are connected via flange members 16. The elongate core 12, outer walls 14 and flange members 16 together define voids 18 that are in fluid communication with the outside of the reinforcement member via openings 20. The outer walls 14 further comprise lip members 22 provided at the edge of the outer walls 14 adjacent to the opening 20 to the void 18. The lip member 22 provide additional contact surfaces and also act to further contain the concrete in the void 18 to further enhance the mechanical bonding between the reinforcing member and the concrete. A variant of the thirteenth embodiment is identical to that depicted in FIGS. 25 and 26 but lacks the lip members 22.

Figures 27, 28:
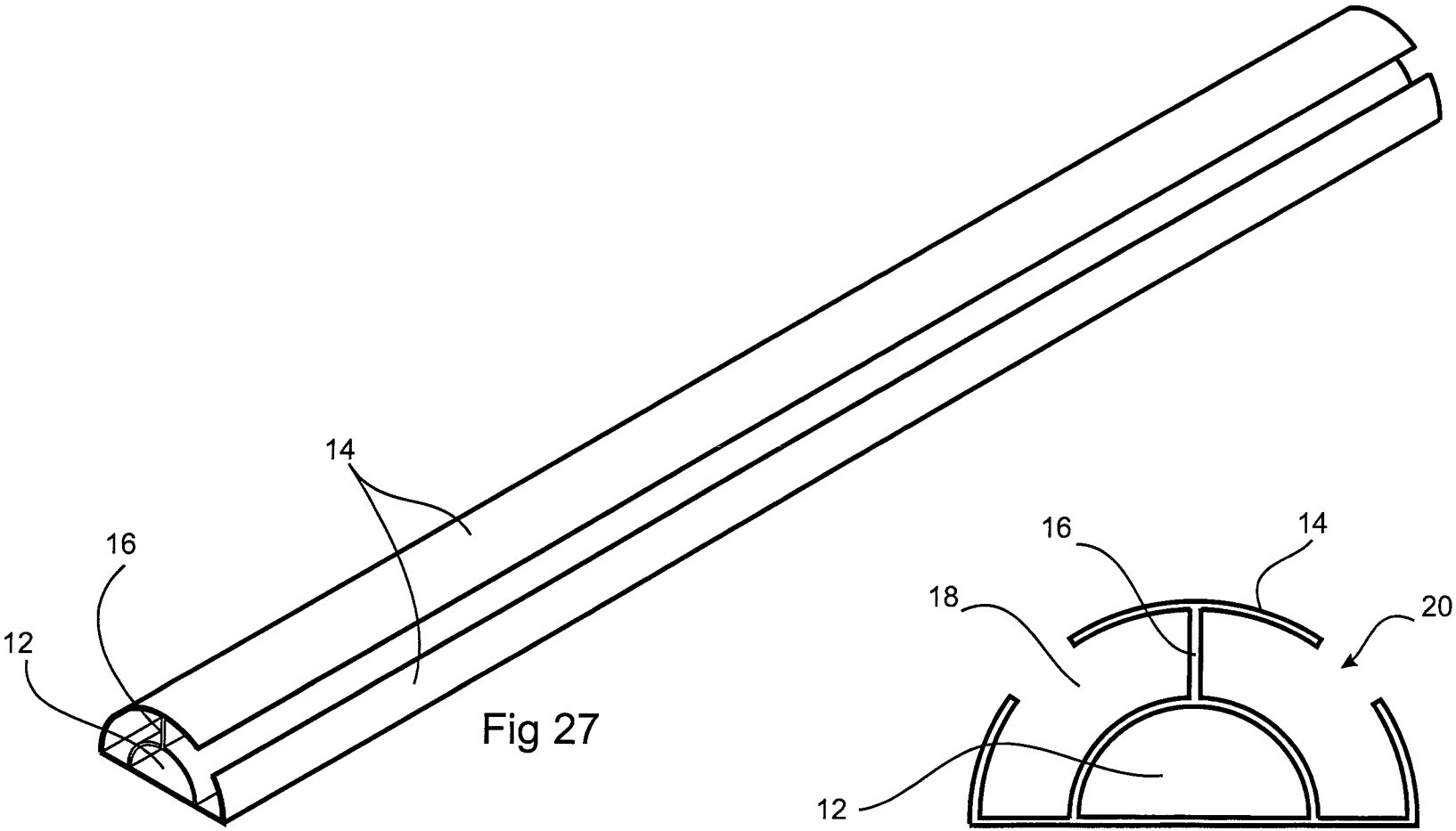
FIGS. 27 and 28 are isometric and cross-sectional views of a fourteenth embodiment of the concrete reinforcing member of the invention.

FIGS. 27 and 28 illustrate a fourteenth embodiment of the invention where the concrete reinforcing member, generally indicated by the numeral 10 has semi circular ("half-moon")

cross sectional shaped elongate core 12 that defines a substantially flat outer face 13. The concrete reinforcing member 10 is essentially half of the concrete reinforcing member illustrated in FIGS. 5 and 6 and includes outer walls 14 have an arcuate cross section defining a convex outer surface and are indirectly connected to the elongate core 12 via flange members in the form of rib members 16 that extend from and along the longitudinal axis of the elongate core 12. The elongate core 12 and the outer walls 14 together define voids 18 that are in fluid communication with the outside of the reinforcement member via openings 20.

Figure 30:
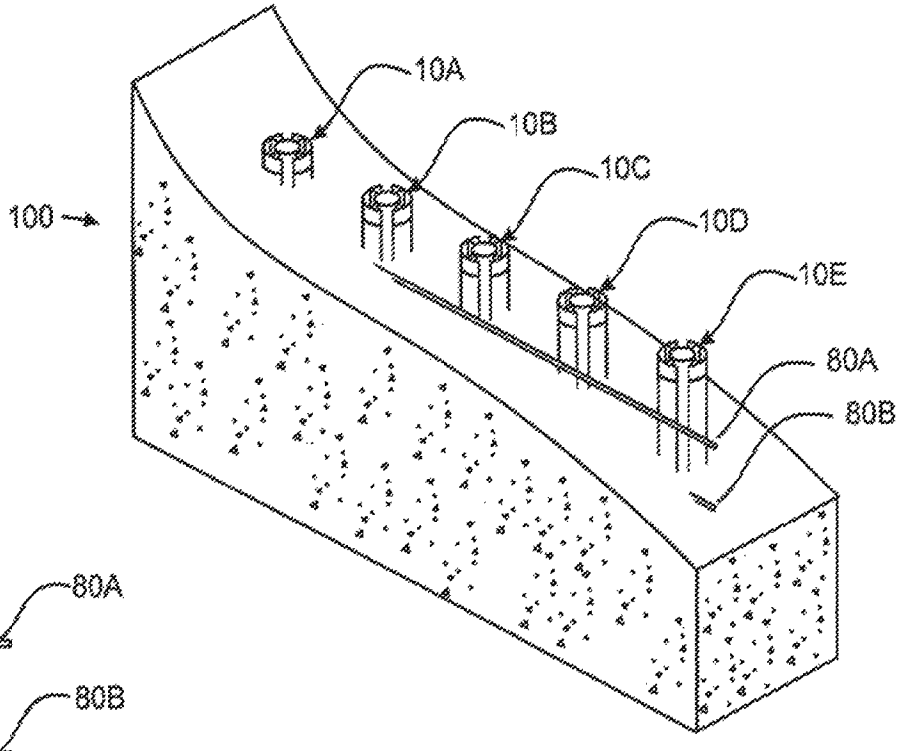
FIGS. 29 and 30 are a side cross sectional and perspective view showing a concrete reinforcing member according to the third embodiment of the invention in situ as it may be used in a concrete wall.
Figure 29:
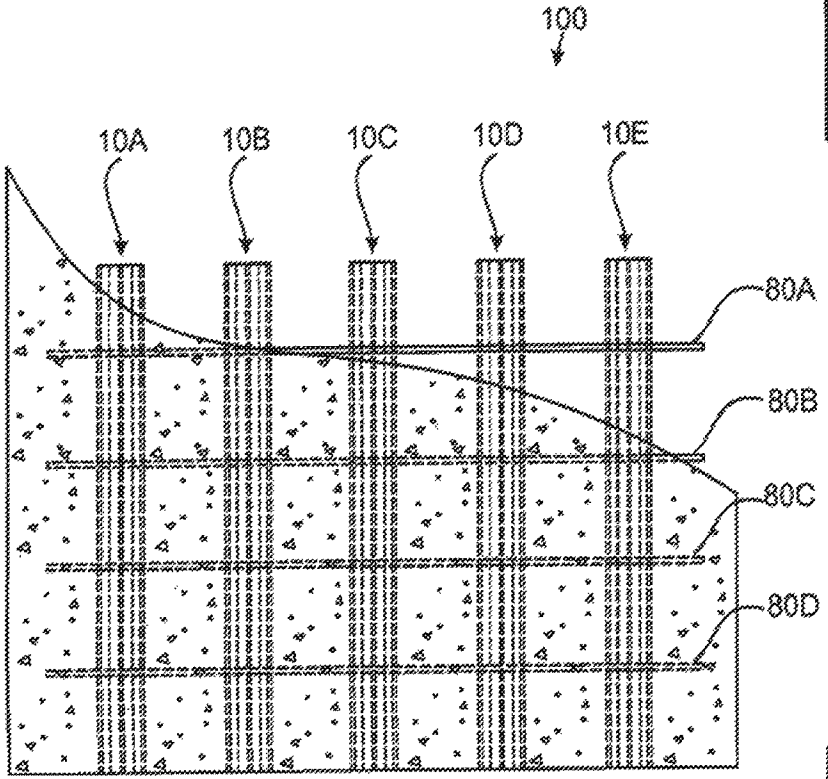

FIGS. 29 and 30 illustrate a concrete wall element, generally indicated by the numeral 100 including five of the concrete reinforcing member depicted in FIGS. 5 and 6, 10A-10E. The wall element 100 further comprises further reinforcement in the form of four lengths of rebar 80A-80D. The rebar 80A-80D can be attached to the reinforcing members 10A-10E using ties (not shown) or any other suitable fixing means as described herein.

Figure 32:
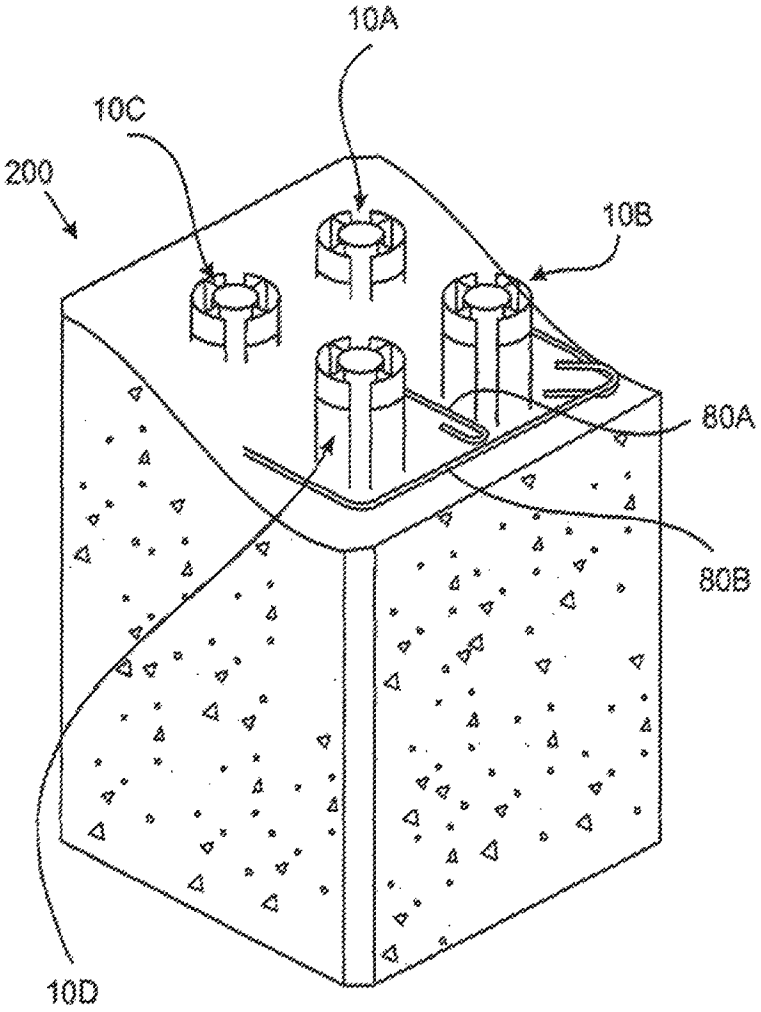
FIGS. 31 and 32 are a top cross sectional and perspective view showing a concrete reinforcing member according to the third embodiment of the invention in situ as it may be used in a concrete pylon, column or beam.
Figure 31:
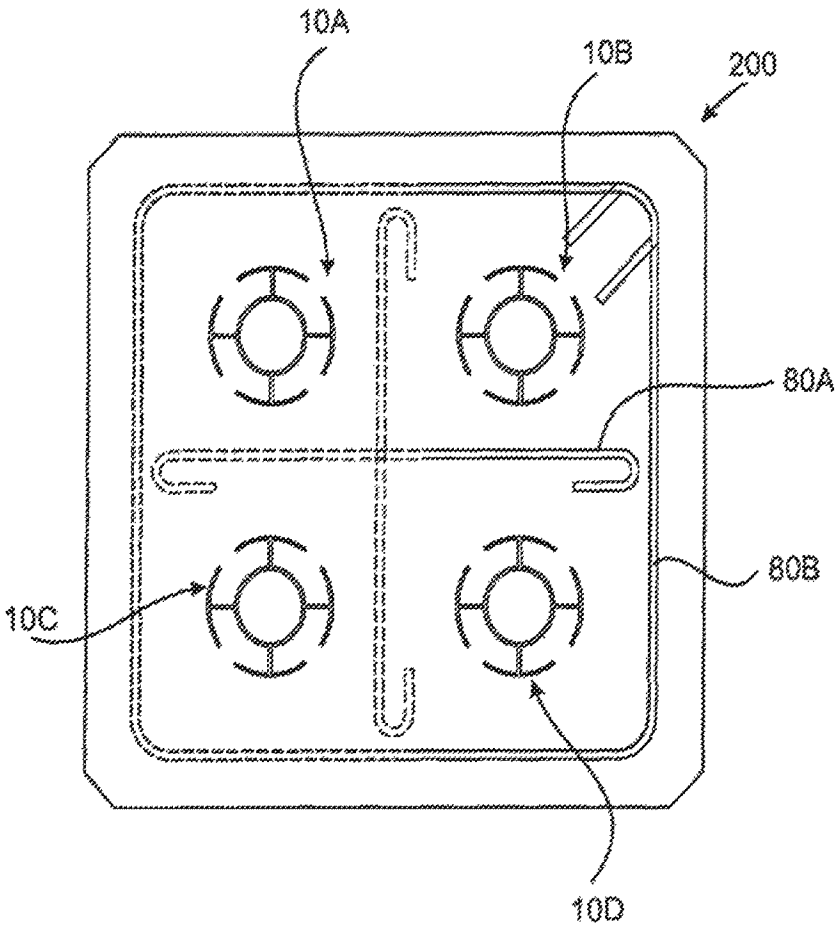

FIGS. 31 and 32 illustrate a concrete column element, generally indicated by the numeral 200 including four of the concrete reinforcing member depicted in FIGS. 5 and 6, 10A-10D. The column element 200 further comprises further reinforcement in the form of rebar 80A and 80B positioned between and around the concrete reinforcing members 10-10D. The rebar 80A-80B can be attached to the reinforcing members 10A-10D using ties (not shown) or any other suitable fixing means as described herein.

Figure 33:
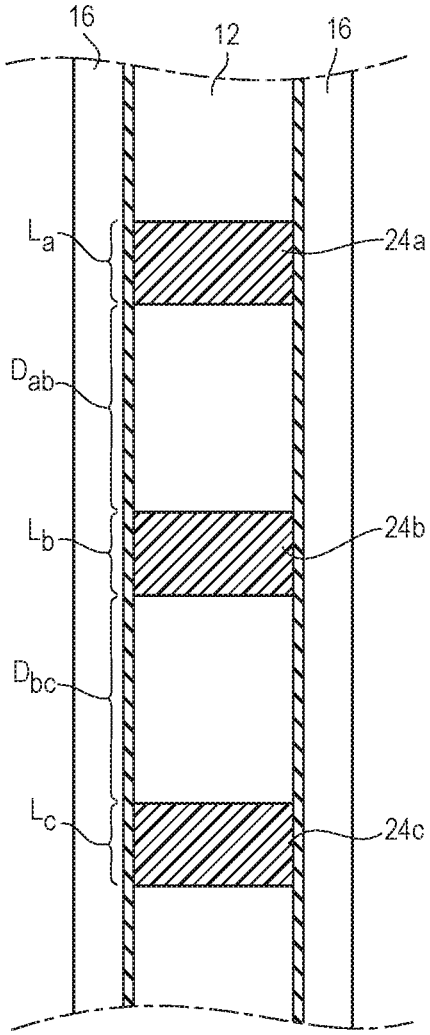
FIG. 33 is a cross-sectional view of an embodiment of the invention, wherein the embodiment is a variation of the embodiment shown in FIGS. 19 and 20.

FIG. 33 is a cross-sectional view of a further embodiment of the invention where the concrete reinforcing member, generally indicated by the numeral 10, is similar to that of FIGS. 19 and 20. The cross-sectional view is defined by a plane that contains two rib members 16 that are aligned with each other. In this embodiment, the core of the concrete reinforcing member 10 is filled at portions 24*a-c* with thermoplastic polymer. FIG. 33 is schematic in nature in that the lengths $L_a$, $L_b$, and $L_c$ of portions 24*a-c*, shapes of portions 24*a-c*, spacings $D_{ab}$, $D_{bc}$ between portions 24*a-c*, orientation of portions 24*a-c*, and the number of the portions are not limited as shown. The figure is provided to show the general concept that the elongate core 12 is filled at multiple places along its length with a thermoplastic polymer.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims.

The present invention is suitable for use in a range of applications and concrete structures including industrial, farming, commercial, marine and residential buildings. Hollow core versions of the reinforcing member of the present invention are generally lighter but when incorporated into a concrete structure deliver equivalent or superior strength to structures using existing reinforcement solutions. Applications and end uses that require reinforcement that is resistant to corrosion (e.g. marine applications) and/or frequent and severe temperature fluctuations are particularly suitable for the application of the present invention.

It should also be appreciated that, depending on requirements, the present invention can be used in conjunction with other reinforcing material such as traditional rebar.

The reinforcing member of the present invention can be used in precast structures or incorporated into structures that are cast in situ. Currently, hollow core concrete structures are manufactured off-site requiring the pre-cast items to be transported to site using heavy road trucks and the use of heavy lifting machinery and/or cranes on-site to assemble the pre-cast items. The current system also requires a lot of space for heavy vehicles parking and cranes to manoeuvre around buildings and surrounding neighbourhoods. For logistical and safety reasons, it is therefore difficult to apply the current methods on building sites where there is limited space, where the ground conditions are unstable e.g. seismic active areas or where the area is in an environment that is sensitive to damage or is otherwise protected.

The present invention is suitable for use in applications where the concrete structure will be exposed to corrosive or otherwise harsh environments. Examples include concrete structures such as seawalls, retaining walls, water breaks, waterfront building structures and floating docks. Other corrosive environments are highly alkaline environments and/or environments where the concrete structures are exposed to de-icing salts and other harsh, snowy environments.

One specific application of the reinforcing member of the present invention is where the invention is used to reinforce the concrete portion of steel framed structures such as warehouses or sheds. In this application, the upper part of the structure consists of metal sheet cladding and the lower half with precast concrete walls including the reinforcing member of the present invention.

With respect to residential building applications, the reinforcing members of the present invention will be designed and used in a manner that meets applicable building guidelines and standards. However, it is expected that the use of the present invention will be more economical, at least through cost savings achieved through the use of concrete members including less concrete and traditional steel reinforcing. In this regard, the reinforcing members of the present invention are designed to enable structures with equivalent performance, in terms of strength etc, but with the use of less concrete and steel reinforcing. One example of efficiencies gained from the present invention is the use of the reinforcing members of the invention in precast panels that will render them lighter but still strong enough to be used for both internal and external walls.

Other buildings such as carports, sheds and other outbuildings could also be economically constructed using concrete reinforced with the reinforcing members of the present invention.

The invention claimed is:

1. A structure for construction comprising:

a. a cementitious material; and, b. a corrosion resistant reinforcing member comprising:

i. an elongate core having a length defining a longitudinal axis and being hollow for at least a part of its length;

ii. a plurality of ribs running along the core and extending radially away from the core;

iii. a plurality of longitudinally extending curved outer walls, each of the outer walls connected to the elongate core by a respective rib, and each of the outer walls extending around the elongate core; and iv. longitudinal edges of mutually adjacent outer walls being spaced apart to form openings between the outer walls;

v. respective voids between the elongate core and the plurality of outer walls, with each void being in fluid communication with an outside of the reinforcement member through a respective opening;

wherein a surface area defined by portions of the elongate core and the plurality of outer walls that define the respective voids is in contact with the cementitious material, wherein the corrosion resistant reinforcing member is made from a material comprising one of a non-metallic material, a thermoplastic polymer, a fiber reinforced thermoplastic polymer, and polyvinyl chloride, and the core is filled at preselected portions of its length with a thermoplastic polymer to provide increased shear strength at the preselected portions.

2. A structure according to claim 1 wherein the corrosion resistant reinforcing member is a single integral and continuous member.

3. A structure according to claim 1 having four outer walls.

4. A structure according to claim 1 wherein the plurality of outer walls are equidistantly spaced around the elongate core member.

5. A structure according to claim 1 wherein the outer walls are convex.

6. A structure according to claim 1 wherein an edge of at least one of the outer walls includes a projection or lip.

7. The structure according to claim 1 wherein the length of the elongate core is the same as a length of the corrosion resistant reinforcing member.

8. The structure according to claim 1 wherein the corrosion resistant reinforcing member is a thermoplastic polymer.

9. The structure according to claim 1 wherein the outer wall is lined with or coated with ceramic, silica, or a polymer having properties different from the corrosion resistant reinforcing member.

* * * * *